US009874826B2

(12) United States Patent
Sugiura et al.

(10) Patent No.: US 9,874,826 B2
(45) Date of Patent: Jan. 23, 2018

(54) TONER, TWO-COMPONENT DEVELOPER, AND COLOR-IMAGE FORMING APPARATUS

(71) Applicants: Hideki Sugiura, Kanagawa (JP); Mio Kumai, Tokyo (JP)

(72) Inventors: Hideki Sugiura, Kanagawa (JP); Mio Kumai, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/925,179

(22) Filed: Oct. 28, 2015

(65) Prior Publication Data

US 2016/0147166 A1 May 26, 2016

(30) Foreign Application Priority Data

Nov. 21, 2014 (JP) ..... 2014-236587

(51) Int. Cl.

| | |
|---|---|
| ***G03G 9/087*** | (2006.01) |
| ***G03G 9/08*** | (2006.01) |
| ***G03G 9/097*** | (2006.01) |
| ***G03G 15/01*** | (2006.01) |

(52) U.S. Cl.

CPC ..... *G03G 9/08782* (2013.01); *G03G 9/0819* (2013.01); *G03G 9/08755* (2013.01); *G03G 9/08791* (2013.01); *G03G 9/09733* (2013.01); *G03G 15/0126* (2013.01); *G03G 2215/0129* (2013.01); *G03G 2215/0141* (2013.01); *G03G 2215/0607* (2013.01)

(58) Field of Classification Search

CPC ..... G03G 9/087872; G03G 9/09733; G03G 9/08782

See application file for complete search history.

(56) References Cited

U.S. PATENT DOCUMENTS

| | | | | |
|---|---|---|---|---|
| 6,413,692 | B1 * | 7/2002 | Cheng | G03G 9/0806 430/137.14 |
| 2005/0277048 | A1 * | 12/2005 | Tomita | G03G 15/2064 430/110.3 |
| 2013/0157185 | A1 * | 6/2013 | Sakashita | G03G 9/08 430/105 |
| 2013/0164669 | A1 * | 6/2013 | Yamashita | C08G 63/916 430/108.4 |
| 2013/0196261 | A1 * | 8/2013 | Uchinokura | G03G 9/08 430/105 |
| 2013/0252157 | A1 * | 9/2013 | Kawakami | G03G 9/08755 430/105 |
| 2015/0072277 | A1 | 3/2015 | Sugiura et al. | |
| 2015/0104740 | A1 * | 4/2015 | Fukuoka | G03G 15/0194 430/107.1 |

FOREIGN PATENT DOCUMENTS

| | | |
|---|---|---|
| JP | 04-024702 | 4/1992 |
| JP | 2015-072445 | 4/2015 |

OTHER PUBLICATIONS

Springett, B. E. A Brief Introduction to Electrophotography. In Handbook of Imaging Materials; Diamond, A., Weiss, D., Eds. Marcel-Dekker, Inc.: New York, 2002; pp. 145-164.*

* cited by examiner

*Primary Examiner* — Christopher D Rodee
(74) *Attorney, Agent, or Firm* — Oblon, McClelland, Maier & Neustadt, L.L.P.

(57) ABSTRACT

A toner, including a binder resin, a release agent, and a colorant, wherein a total amount of hydrocarbon compounds having 33 to 35 carbon atoms in the toner measured by ion attachment mass spectrometry (IAMS) is 40% to 70% in terms of a signal intensity ratio.

12 Claims, 4 Drawing Sheets

TONER, TWO-COMPONENT DEVELOPER, AND COLOR-IMAGE FORMING APPARATUS

BACKGROUND OF THE INVENTION

Field of the Invention

The present invention relates to a toner, a two-component developer, and a color-image forming apparatus.

Description of the Related Art

In an image forming apparatus, such as an electrophotographic image forming apparatus and an electrostatic recording apparatus, an electrostatic latent image formed on a photoconductor (hereinafter may be referred to as an "electrostatic latent image bearer" or "electrophotographic photoconductor") is developed to form a visible image with a toner, the visible image is transferred onto a recording medium, such as paper, to form a transferred image on the recording medium, and the transferred image is fixed by application of heat and pressure, to thereby form an image. When a full-color image is formed, four color toners; i.e., black, yellow, magenta, and cyan toners are generally used for developing, and visible images for respective colors are transferred and put on top of one another on a recording medium, followed by fixing with heat and pressure.

In order to reduce a load to the global environmental, there is a need for a toner further improved in low temperature fixing ability. In an attempt to allow the toner to soften at lower temperature in order to improve the low temperature fixing ability of the toner, it is necessary for the release agent in the toner to melt at low temperature. However, there is a problem that the release agent melting at low temperature volatilizes during output of images, attaches to an exhaust filter, and thus degrades exhausting performance of the exhaust filter.

Moreover, in order to ensure reliability of images, it becomes important to ensure charging stability of the developer. In particular, there is a problem that use of the release agent melting at low temperature under an environment of high temperature and high humidity (for example, 45° C. in temperature, and 80% RH in humidity) causes spent of the release agent on a carrier of a two-component developer (which may be referred to as "carrier spent"), lowering charging stability.

Therefore, it is difficult to improve resistance to the spent property of a release agent melting at low temperature.

Meanwhile, as a method for softening the toner, it is proposed to use a crystalline resin as a binder resin of the toner (see, Japanese Examined Patent Publication No. 04-024702).

However, it is difficult to solve the aforementioned problems only by using the crystalline resin as the binder resin.

SUMMARY OF THE INVENTION

The present invention aims to provide a toner capable of achieving ultimate low temperature fixing ability and reduction of clogging of an exhaust filter, capable of achieving both reduction of carrier spent under an environment of high temperature and high humidity and charging stability at high levels, and capable of forming an image having high quality.

As means for solving the aforementioned problems, a toner of the present invention includes a binder resin, a release agent, and a colorant, wherein a total amount of the hydrocarbon compounds having 33 to 35 carbon atoms in the toner measured by ion attachment mass spectrometry (JAMS) is 40% to 70% in terms of a signal intensity ratio.

The present invention can provide a toner that can achieve ultimate low temperature fixing ability and reduction of clogging of an exhaust filter, and that can highly achieve both reduction of carrier spent under high temperature and high humidity and charging stability to form an image having high quality.

DETAILED DESCRIPTION OF THE INVENTION (Toner)

Figure 1:
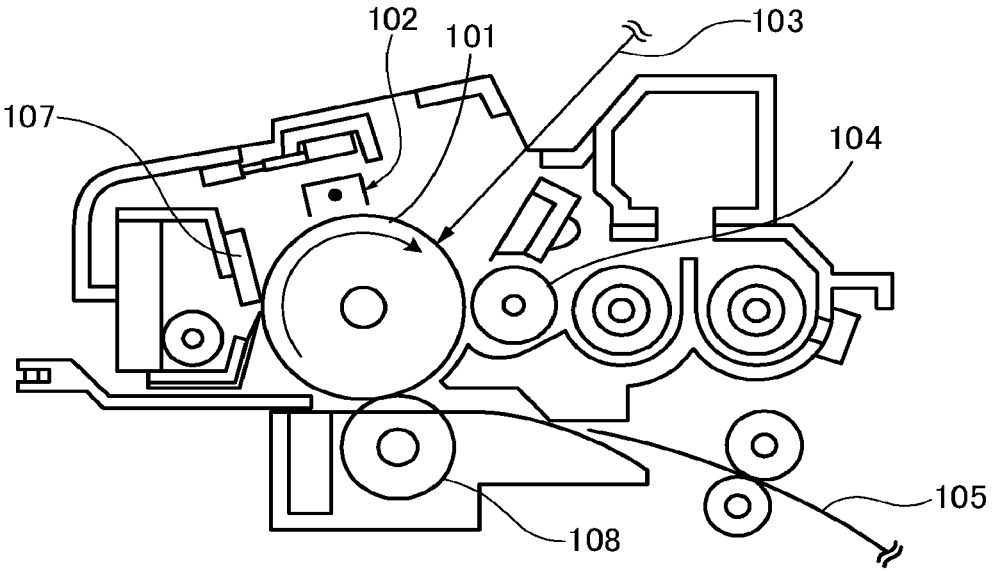
FIG. 1 is a schematic view illustrating one example of a process cartridge used in the present invention.

A toner of the present invention contains a colorant, a binder resin, and a release agent, and further contains other components if necessary.

As a result of the researches diligently performed by the present inventors to achieve the aforementioned object, the present inventors found that a toner, a color-image forming apparatus, a color image forming method, a process cartridge, and a two-component developer can be provided, where the toner is a toner containing a colorant, a binder resin, and a release agent, where a total amount of the hydrocarbon compounds having 33 to 35 carbon atoms in the toner measured by ion attachment mass spectrometry (IAMS) is 40% to 70% in terms of a signal intensity ratio, and the toner can achieve ultimate low temperature fixing ability and reduction of clogging of exhaust filter, and can highly achieve both reduction of carrier spent under high temperature and high humidity and charging stability to form an image having high quality; and the color-image forming apparatus can ensure correspondency to high-speed printing by using the toner.

The mechanism of the toner has been currently revealed, but is speculated by some analytical data as follows.

The toner necessarily contains a colorant, a binder resin, and a release agent, where a total amount of the hydrocarbon compounds having 33 to 35 carbon atoms in the toner measured by ion attachment mass spectrometry (IAMS) is 40% to 70% in terms of a signal intensity ratio. It is believed that the hydrocarbon compound having 33 to 35 carbon atoms is mainly derived form a release agent component contributed to low temperature fixing ability and a low-volatile component. When the total amount of the hydrocarbon compounds having 33 to 35 carbon atoms in the toner measured by ion attachment mass spectrometry (IAMS) is 40% or more, low temperature fixing ability and reduction of the low-volatile component of the toner can be achieved. When the total amount of the hydrocarbon compounds having 33 to 35 carbon atoms is 70% or less, low temperature fixing ability and release agent volatile property is appropriate, and thus release agent spent on a carrier is excellent. Therefore, unless the components of the release agent are distributed in a certain degree (especially, in a side where the number of carbon atoms are large), it is not possible to respond to spent of the release agent on the carrier.

Here, the number of the hydrocarbon compound having 33 to 35 carbon atoms measured by the ion attachment mass spectrometry (IAMS) is a measurement value obtained by measuring a toner as a sample. The toner may contain the hydrocarbon compound having 33 to 35 carbon atoms in any form. The derivation of the hydrocarbon compound having 33 to 35 carbon atoms is not particularly limited and may be appropriately selected depending on the intended purpose. The hydrocarbon compound having 33 to 35 carbon atoms may be contained in, for example, a release agent and a low temperature fixing assisting agent.

An amount of the toner reduced when the toner is heated at 165° C. for 10 minutes is preferably 0.01% by mass to 0.40% by mass. When the amount thereof is within the aforementioned range, an amount of a low-volatile component in the toner during fixing the toner, the low-volatile component being derived from the release agent, can be reduced. As a result, it is preferable because the volatile component reaching an exhaust filter can be also reduced. Here, when the amount thereof is 0.01% by mass or more, an amount of the volatile component is appropriate, and low temperature fixing ability of the toner can be ensured. When the amount thereof is 0.40% by mass or less, it is excellent because clogging of an exhaust filter is not caused.

An amount of the toner reduced when the toner is heated to 250° C. after heated at 165° C. for 10 minutes is preferably 0.1% by mass to 5.0% by mass. When the amount thereof is within the aforementioned range, an amount of carrier spent component derived from another component other than release agent can be defined. When the amount thereof is 0.1% by mass or less, it is excellent because carrier spent is low and low temperature fixing ability of the toner can be ensured. When the amount of thereof is 5.0% by mass or less, it is excellent because carrier spent does not occur, and background fog does not occur due to reduction of a charge amount even under an environment of high temperature and high humidity.

<Measurement of Hydrocarbon Compound by IAMS (Ion Attachment Mass Spectrometry)>

The total amount of the hydrocarbon compounds having 33 to 35 carbon atoms in a sample can be evaluated by ion attachment mass spectrometry (IAMS) described below. Here, in the IAMS, examples of the sample include a toner and a release agent. Even if the sample is a toner state, the hydrocarbon compound can be isolated from the toner state, and then can be evaluated.

(1) Device: IAMS (product of ANELVA)

(2) Measurement method: Measured under the following heating conditions: 30° C.→(128° C./min)→130° C.→(32° C./min)→300° C.

(3) Amount of sample: 5 mg (4) Outline

The IAMS is an abbreviation of ion attachment mass spectrometry, and is a new method for measuring mass without destroying molecules.

In the IAMS, a lithium ion ($Li^+$) is attached to a neutral molecule (M) that is a sample gas, to form a $MLi^+$ ion (adduct ion).

A step of attaching M with $Li^+$($M\text{-}Li^+$) is a moderate step, and destroying molecules does not occurs (fragment).

The adduct ion can be subjected to mass spectrometry, and the obtained mass of the adduct ion is deducted from mass of $Li^+$ ion (7 amu), to determine a molecular weight of the original sample gas.

As there is no fragment ion, the evaluation can be performed in real time without isolating a mixed sample.

(5) Analysis of Results

Using the obtained mass component, a ratio of the total number of the hydrocarbon compound having 33 to 35 carbon atoms to another hydrocarbon compound is evaluated in terms of signal intensity ratio. Note that, in the present invention, it is characteristic in that a value obtained by the IAMS is used as the number of the carbon. The conventional GCMS (gas chromatography-mass spectrometry) cannot be used because the number of carbon atoms in the sample cannot be evaluated with high precision.

<Measurement of Amount of Toner Reduced During Heating>

An amount of the toner reduced (heated at 165° C. for 10 minutes, and heated to 250° C. after heated at 165° C. for 10 min) can be preferably evaluated using a high sensitivity TGA device described below, under the following conditions.

(1) Device: TGA device model Q5000IR type (product of TA Instruments)

(2) Measurement method: Measured by the following heating conditions.

Room temperature→[10° C./minute]→165° C.→[maintaining for 10 minutes]→[10° C./minute]→250° C.

(3) Weight of sample: 0.35 mg (4) Measurement atmosphere: Nitrogen 35 cc/minute (5) Evaluation: An amount of the sample reduced when the sample is heated for 165° C. for 10 minutes, and an amount of the sample reduced when the sample is heated to 250° C. after heated for 165° C. for 10 minutes can be evaluated.

The toner preferably contains ethyl acetate as a volatile organic compound in an amount of 1 μg/g to 30 μg/g. As a result, due to a melting effect caused by adhesion of a small amount of the ethyl acetate to the toner, the toner is further improved in low temperature fixing ability. When an amount of ethyl acetate is 1 μg/g or more, the melting effect may be improved. When the amount thereof is 30 μg/g or more, the melting effect may be improved, and the toner may be excellent in powder flowability.

<Quantitative Evaluation of Ethyl Acetate>

The qualitative evaluation and the quantitative evaluation of ethyl acetate are performed by a cryotrap-GCMS method.

(1) Device: QP2010 (product of SHIMADZU CORPORATION), data analyzing software: GCMS solution (product of SHIMADZU CORPORATION), heating device: Py2020D (product of Frontier Laboratories Ltd.)

(2) Amount of sample: 10 mg (3) Conditions of thermal extraction: heating temperature: 180° C., healing time: 15 minutes (4) Cryotrap: −190° C.

(5) Column: Ultra ALLOY-5, L=30 m, ID=0.25 mm, Film=0.25 μm (6) Heating column: 60° C. (retained for 1 minute)→(10° C./min)→130° C.→(20° C./min)→300° C. (retained for 9.5 minutes)

(7) Pressure of carrier gas: 56.7 kPa, constantly (8) Column flow rate: 1.0 mL/min (9) Ionization method: EI method (70 eV)

(10) Mass range: m/z=29 to 700

The toner preferably has a core-shell structure. The toner having the core-shell structure can be designed to have low temperature fixing ability, and be appropriately controlled in charging ability.

<Confirmation of Toner Core-Shell Structure>

Confirmation of the core-shell structure of the toner can be evaluated based on a method using the following TEM (transmission electron microscope).

The core-shell structure is defined as a state that the toner surface is covered with a contrast component that is different from the interior of the toner (shell layer). A thickness of the shell layer is preferably 50 nm or more.

First, about one spatula of the toner is embedded and hardened in an epoxy resin. The sample is exposed to a gas using ruthenium tetroxide, osmium tetroxide, or any other stain for 1 minute to 24 hours, to thereby stain the shell layer and the core interior distinguishably. The exposition time is appropriately adjusted according to the contrast observed. A cross-section of the toner is obtained with a knife, and an ultra-thin section (with a thickness of 200 nm) of the toner is produced with an ultramicrotome (ULTRACUT UCT, product of Leica Co., Ltd., using diamond knife). After this, the ultra-thin section is observed with a TEM (transmission electron microscope, H7000, product of Hitachi High-Technologies Corporation) at an accelerating voltage of 100 kV. The shell layer and the core may be distinguishable without stains depending on the composition thereof, and then are evaluated without stains. The compositional contrast can be also imparted by other means such as a selective etching. It is also preferable that TEM observation and evaluation of shell layer are performed after the aforementioned pretreatment.

<Binder Resin>

The binder resin preferably contains a crystalline resin.

The binder resin preferably contains the crystalline resin in an amount of 10% by mass or more, more preferably 20% by mass or more, still more preferably 30% by mass or more, relative to the total amount of the binder resin.

A kind of the binder resin is not particularly limited and may be appropriately selected depending on the intended purpose, and the crystalline resin may be used in combination with a non-crystalline resin. Note that, it is preferable that a resin obtained by controlling composition of monomer and degree of polymerizing monomers be used so as to reduce an amount of volatile components volatilized by applying heat at 250° C. or less.

In the present invention, the "crystalline" is defined to as a substance in which atoms and molecules are spatially arranged so as to have a repeated pattern, and to as a substance exhibiting a diffraction pattern by a general X-ray diffraction device.

The crystalline resin is not particularly limited and may be appropriately selected depending on the intended purpose, so long as it has crystallinity. Examples thereof include a polyester resin, a polyurethane resin, a polyurea resin, a polyamide resin, a polyether resin, a vinyl resin, and a modified crystalline resin. These may be used alone or in combination thereof. Among them, a polyester resin, a polyurethane resin, a polyurea resin, a polyamide resin, and a polyether resin are preferable, a resin having at least one of a urethane skeleton and a urea skeleton is more preferable, a straight chain polyester resin and a composite resina containing the straight chain polyester resin are particularly preferable.

As the resin having at least one of a urethane skeleton and a urea skeleton, the polyurethane resin, the polyurea resin, a urethane-modified polyester resin, and a urea-modified polyester resin are favorable. The urethane-modified polyester resin is a resin obtained by reacting a polyester resin having an isocyanate group at a terminal with polyol. The urea-modified polyester resin is a resin obtained by reacting a polyester resin having an isocyanate group at a terminal with amines.

A maximum peak temperature of melting heat of the crystalline resin is preferably 45° C. to 70° C., more preferably 53° C. to 65° C., still more preferably 58° C. to 62° C., in terms of both low temperature fixing ability and heat resistant storage stability. When the maximum peak temperature thereof is within a range from 45° C. to 70° C., the toner can be excellent in low temperature fixing ability and heat resistant storage stability.

The binder resin is not particularly limited and may be appropriately selected depending on the intended purpose, but it preferably contains a polyester resin. As a result, it is preferable that the allowance of designing low temperature fixing ability increase, a shape of particles, which influences charging ability of the toner, can be controlled, and thus the toner electrically charged can be prevented from decreasing.

The polyester resin preferably contains a crystalline polyester resin and a non-crystalline polyester resin.

<<Crystalline Polyester Resin>>

The crystalline polyester resin means not only a polymer formed of 100% of a polyester structure as a constituent component, but also a polymer (copolymer) obtained by polymerizing a component constituting polyester with another component. Note that, in the latter case, an amount of the another component except polyester constituting the polymer (copolymer) is 50% by mass or less.

The crystalline polyester resin is synthesized, for example, by a polyvalent carboxylic acid and a polyhydric alcohol. Note that, as the crystalline polyester resin, commercially available products may be used, or synthesized products may be used.

Examples of the polyvalent carboxylic acid include: aliphatic dicarboxylic acids such as oxalic acid, succinic acid, glutaric acid, adipic acid, suberic acid, azelaic acid, sebacic acid, 1,9-nonanedicarboxylic acid, 1,10-decanedicarboxylic acid, 1,12-dodecanedicarboxylic acid, 1,14-tetradecanedicarboxylic acid, 1,18-octadecanedicarboxylic acid; and aromatic dicarboxylic acids such as diacids such as phthalic acid, isophthalic acid, terephthalic acid, naphthalene-2,6-dicarboxylic acid, malonic acid, and mesakonin acid. Examples thereof further include anhydride and lower alkyl ester of those listed above.

Examples of trivalent or higher carboxylic acids include: 1,2,4-benzenetricarboxylic acid, 1,2,5-benzenetricarboxylic acid, 1,2,4-naphthalenetricarboxylic acid; and anhydride and lower alkyl ester of those listed above. These may be used or in combination thereof.

As an acid component, the crystalline polyester resin may contain a dicarboxylic acid component having the sulfonate group, in addition to the aliphatic dicarboxylic acid and the aromatic dicarboxylic acid. Moreover, it may contain a dicarboxylic acid component having a double bond, in addition to the aliphatic dicarboxylic acid and the aromatic dicarboxylic acid.

The polyhydric alcohol component is preferably an aliphatic diol, and more preferably a straight-chain aliphatic diol having 7 to 20 carbon atoms in the main chain. When the aliphatic diol is a branched aliphatic diol, the crystallinity of the polyester resin may be poor to thereby cause depression of the melting point. When the aliphatic diol having more than 7 carbon atoms in the main chain is reacted with an aromatic dicarboxylic acid for polycondensation, a melting temperature can be lowered, and low temperature fixing ability of the toner can be improved.

Moreover, when the number of carbon atoms in the main chain is 20 or less, it is easy to obtain materials for practical use. The number of carbon atoms in the main chain is more preferably 14 or less.

Examples of the aliphatic diol include ethylene glycol, 1,3-propanediol, 1,4-butanediol, 1,5-pentanediol, 1,6-hexanediol, 1,7-heptanediol, 1,8-octanediol, 1-9-nonanediol, 1,10-decanediol, 1,11-undecanediol, 1,12-dodecanediol, 1,13-tridecanediol, 1,14-tetradecanediol, 1,18-octadecanediol and 1,14-eicosanedecanediol. These may be used alone or in combination thereof. Among these, 1,8-octanediol, 1-9-nonanediol, and 1,10-decanediol are preferable in terms of easy availability.

Examples of trihydric or higher alcohol include glycerin, trimethylolethane, trimethylolpropane, and pentaerythritol. These may be used alone or in combination thereof.

The polyhydric alcohol component preferably contains the aliphatic diol in an amount of 80% by mole or more, more preferably 90% by mole or more. When an amount of the aliphatic diol is 80% by mole or more, crystallinity of the polyester resin increases, a melting temperature thereof increases, and thus the toner is excellent in toner blocking resistance, image storage stability, and low temperature fixing ability.

For optional purposes such as adjusting an acid value and a hydroxyl value, it is possible to add the polyvalent carboxylic acid and the polyhydric alcohol at the final stage of the synthesis. Examples of the polyvalent carboxylic acid include: aromatic carboxylic acids such as terephthalic acid, isophthalic acid, phthalic anhydride, trimellitic anhydride, pyromellitic acid, and naphthalene dicarboxylic acid; aliphatic carboxylic acids such as maleic anhydride, fumaric acid, succinic acid, alkenyl succinic anhydride, and adipic acid; and alicyclic carboxylic acid such as cyclohexanedicarboxylic acid.

Examples of the polyhydric alcohol include: aliphatic diols such as ethylene glycol, diethylene glycol, triethylene glycol, propylene glycol, butanediol, hexanediol, neopentyl glycol, and glycerin; alicyclic diols such as cyclohexanediol, cydohexanedimethanol, and hydrogenated bisphenol A; and aromatic diols such as bisphenol A-ethylene oxide adduct and bisphenol A-propylene oxide adduct.

The "crystalline polyester resin" means not only a polymer formed of 100% by mass of a polyester structure as a constituent component, but also a polymer (copolymer) obtained by polymerizing a component constituting polyester with another component. Note that, in the latter case, an amount of the another component except polyester constituting the polymer (copolymer) is 50% by mass or less.

The crystalline polyester resin may be produced at a polymerization temperature of from 180° C. to 230° C. The reaction is promoted by reducing the pressure in the reaction system if necessary, and removing water and alcohol to be produced from the condensation.

When a polymerizable monomer is insoluble or incompatible at the reaction temperature, a solvent having a high boiling point as a solubilizing agent can be added thereto, to dissolve the polymerizable monomer. The polycondensation reaction is performed during removing the solubilizing agent. When a polymerizable monomer having poor compatibility exists through polycondensation reaction, the polymerizable monomer having poor compatibility can be condensed with an acid or an alcohol to be polymerized and condensed with the polymerizable monomer in advance, and then the resultant product may be polycondensed with a main component.

Examples of the catalyst that can be used for the production of the crystalline polyester resin include: alkali metal compounds such as sodium and lithium; alkaline-earth metal compounds such as magnesium and calcium; metal compounds such as zinc, manganese, antimony, titanium, tin, zirconium, and germanium; phosphite compounds; phosphate compounds; and amine compounds.

Specific examples of the catalyst include compounds such as sodium acetate, sodium carbonate, lithium acetate, lithium carbonate, calcium acetate, calcium stearate, magnesium acetate, zinc acetate, zinc stearate, zinc naphthenate, zinc chloride, manganese acetate, manganese naphthenate, titanium tetraethoxide, titanium tetrapropoxide, titanium tetraisopropoxide, titanium tetrabutoxide, antimony trioxide, triphenyl antimony, tributylantimony, tin formate, tin oxalate, tetraphenyltin, dibutyltindichloride, dibutyltinoxide, diphenyltinoxide, zirconium tetrabutoxide, zirconium naphthenate, zirconyl carbonate, zirconyl acetate, zirconyl stearate, zirconyl octylate, germanium oxide, triphenylphosphite, tris(2,4-di-t-butylphenyl)phosphite, ethyltriphenylphosphoniumbromide, triethylamine, and triphenylamine.

A melting point of the crystalline polyester resin is preferably 45° C. to 70° C., more preferably 53° C. to 65° C. When the melting point thereof is 45° C. or more, the toner does not cause blocking during storage, and storage property of the toner and storage property of a fixed image after fixing are excellent. Moreover, when the melting point thereof is 70° C. or less, low temperature fixing ability of the toner can be sufficiently obtained.

The melting point of the crystalline polyester resin can be obtained as a peak temperature of an endothermic peak obtained by differential scanning calorimetry (DSC) described above.

An acid value of the crystalline polyester resin (the quantity of KOH in the mg unit necessary for neutralizing 1 g of resin) is preferably 3.0 mg KOH/g to 30.0 mg KOH/g, more preferably 6.0 mg KOH/g to 25.0 mg KOH/g, still more preferably 8.0 mg KOH/g to 20.0 mg KOH/g.

When the acid value thereof is 3.0 mg KOH/g or more, the resin is excellent in dispersibility in water, and particles of the resin can be easily produced by a wet process. Moreover, particles thereof is excellent in stability during condensation, and thus the toner can be efficiently produced. On the other hand, the acid value thereof is 30.0 mg KOH/g or less, absorbency of the toner is appropriate, and environmental stability of the toner is excellent.

The weight average molecular weight (Mw) of the crystalline polyester resin is preferably 6,000 to 35,000. When the weight average molecular weight (Mw) is 6,000 or more, the toner would not sink into the surface of the recording medium such as paper when fixed thereon to be thereby prevented from being unevenly fixed, or would not weaken the strength of resistance of the fixed image to folding. When the weight average molecular weight (Mw) is 35,000 or less, the viscosity of the toner when melted would not be so high that the temperature at which the viscosity reaches the suitable level for fixing would be high, to thereby prevent the low temperature fixability from being degraded.

An amount of the crystalline polyester resin in the toner is preferably 10% by mass or more, more preferably 20% by mass or more, still more preferably 20% by mass to 85% by mass. When the amount of the crystalline polyester resin is 10% by mass or more, toner having excellent low temperature fixing ability can be obtained. When the amount thereof is 85% by mass or less, the toner excellent in toner strength and strength of a fixed image can be obtained, and the toner may be excellent in charging ability.

The crystalline polyester resin preferably contains a crystalline polyester resin synthesized using an aliphatic polymerizable monomer (hereinafter, may be referred to as "crystalline aliphatic polyester resin") as a main component (50% by mass or more). In this case, a compositional ratio of the aliphatic polymerizable monomer constituting the crystalline aliphatic polyester resin is preferably 60 mol % or more, more preferably 90 mol % or more. Note that, as the aliphatic polymerizable monomer, the above-described aliphatic diols and dicarboxylic acids can be favorably used.

<<Non-Crystalline Polyester Resin>>

Examples of the non-crystalline polyester resin include a modified polyester resin and an unmodified polyester resin. The non-crystalline polyester resin contains the modified polyester resin, and thus the allowance of designing low temperature fixing ability increases and charging ability of the toner can be prevented from decreasing.

—Modified Polyester Resin—

As the modified polyester resin, a polyester prepolymer having the isocyanate group can be used.

Examples of the polyester prepolymer having the isocyanate group (A) include a product obtained by reacting such a polyester as is a polycondensation product of polyol (1) and polycarboxylic acid (2) and as has an active hydrogen group, further with polyisocyanate (3).

Examples of the active hydrogen group of the polyester include a hydroxyl group (an alcoholic hydroxyl group and a phenolic hydroxyl group), an amino group, a carboxyl group, and a mercapto group. Among them, an alcoholic hydroxyl group are preferable.

Examples of the polyol (1) include diol (1-1) and trihydric or higher polyol (1-2). Diol (1-1) alone, or a mixture of diol (1-1) and a small amount of trihydric or higher polyol (1-2) are preferred.

Examples of the diol (1-1) include alkylene glycols (e.g., ethylene glycol, 1,2-propylene glycol, 1,3-propylene glycol, 1,4-butanediol, and 1,6-hexanediol); alkylene ether glycols (e.g., diethylene glycol, triethylene glycol, dipropylene glycol, polyethylene glycol, polypropylene glycol, and polytetramethylene ether glycol); alicyclic diols (e.g., 1,4-cyclohexanedimethanol and hydrogenated bisphenol A); bisphenols (e.g., bisphenol A, bisphenol F, and bisphenol S); alkylene oxide (e.g., ethylene oxide, propylene oxide, and butylene oxide) adducts of the above-listed alicyclic diols; and alkylene oxide (e.g., ethylene oxide, propylene oxide, and butylene oxide) adducts of the above-listed bisphenols. Among them, alkylene glycols and alkylene oxide adducts of bisphenols having 2 to 12 carbon atoms are preferable. Alkylene oxide adducts of bisphenols, and combinations of the alkylene oxide adducts of bisphenols with alkylene glycols having 2 to 12 carbon atoms are particularly preferable.

Examples of the trihydric or higher polyol (1-2) include trihydric to octahydric or higher aliphatic polyalcohols (e.g., glycerin, trimethylolethane, trimethylolpropane, pentaerythritol, and sorbitol); trihydric or higher phenols (e.g., trisphenol PA, phenol novolac, and cresol novolac); and alkylene oxide adducts of the above trihydric or higher polyphenols.

Examples of the polycarboxylic acid (2) include dicarboxylic acid (2-1) and trivalent or higher polycarboxylic acid (2-2), with the dicarboxylic acid (2-1) alone or a mixture of the dicarboxylic acid (2-1) and a small amount of trivalent or higher polycarboxylic acid (2-2) being preferred.

Examples of the dicarboxylic acid (2-1) include alkylene dicarboxylic acids (e.g., succinic acid, adipic acid, and sebacic acid); alkenylene dicarboxylic acids (e.g., maleic acid and fumaric acid); aromatic dicarboxylic acids (e.g., phthalic acid, isophthalic acid, terephthalic acid, and naphthalene dicarboxylic acid). Among them, alkenylenedicarboxylic acids having 4 to 20 carbon atoms and aromatic dicarboxylic acids having 8 to 20 carbon atoms are preferable.

Examples of the trivalent or higher polycarboxylic acid (2-2) include aromatic polycarboxylic acids having 9 to 20 carbon atoms (e.g., trimellitic acid and pyromellitic acid). Notably, the polycarboxylic acid (2) may be reacted with the polyol (1) using lower alkyl esters (e.g., methyl ester, ethyl ester, and isopropyl ester) or acid anhydrides of the above compounds.

A ratio of the polyol (1) to the polycarboxylic acid (2) is typically 2/1 to 1/1, preferably 1.5/1 to 1/1, more preferably 1.3/1 to 1.02/1, in terms of the equivalent ratio [OH]/[COOH] of the hydroxyl group [OH] to the carboxyl group [COOH].

Examples of the polyisocyanate (3) include aliphatic polyisocyanates (e.g., tetramethylene diisocyanate, hexamethylene diisocyanate, and 2,6-diisocyanate methylcaproate); alicyclic polyisocyanates (e.g., isophorone diisocyanate and cyclohexylmethane diisocyanate); aromatic diisocyanates (e.g., tolylene diisocyanate and diphenylmethane diisocyanate); aromatic aliphatic diisocyanates (e.g., $\alpha,\alpha,\alpha',\alpha'$-tetramethyl xylylene diisocyanate); isocyanurates; polyisocyanates blocked with phenol derivative, oxime, caprolactam or the like; and combinations of two or more thereof.

The ratio of the polyisocyanate (3), as the equivalent ratio [NCO]/[OH] of isocyanate group [NCO] to hydroxyl group [OH] of the polyester having the hydroxyl group, is preferably 5/1 to 1/1, more preferably 4/1 to 1.2/1, still more preferably 2.5/1 to 1.5/1. When the [NCO]/[OH] is 5 or more, the resultant toner is excellent in low temperature fixing ability. When a mole ratio of the [NCO] is 1 or more, an amount of urea in the modified polyester is appropriate, and the resultant toner is excellent in hot offset resistance.

An amount of the constituent components of polyisocyanate (3) in prepolymer (A) having an isocyanate group at a terminal is preferably 0.5% by mass to 40% by mass, more preferably 1 by mass to 30% by mass, still more preferably 2% by mass to 20% by mass. When the amount thereof is 0.5% by mass or more, the toner is excellent in hot offset resistance, and both in heat resistant storage stability and in low temperature fixing ability. On the other hand, the amount thereof is 40% by mass or less, the toner is excellent in low temperature fixing ability.

The number of isocyanate group per molecule of the prepolymer (A) having the isocyanate group is preferably 1 or more, more preferably 1.5 to 3 on average, still more preferably 1.8 to 2.5 on average. When the number thereof is 1 or more per molecule, a molecular weight of the modified polyester after cross-linking and/or elongation is appropriate, and the toner is excellent in hot offset resistance.

If necessary, amines can be used as a crosslinking agent and/or an elongating agent.

Examples of the amines (B) include diamine (B1), trivalent or higher polyamine (B2), amino alcohol (B3), amino mercaptan (B4), amino acid (B5), and a product (B6) obtained by blocking an amino group of any of B1 to B5.

Examples of the diamine (B1) include: aromatic diamine (e.g., phenylenediamine, diethyltoluene diamine, and 4,4'-diaminodiphenylmethane), alicyclic diamine (4,4'-diamino-3,3'-dimethyldicyclohexyl methane, diamine cyclohexane, and isophorone diamine), and aliphatic diamine (e.g., ethylene diamine, tetramethylene diamine, and hexamethylenediamine).

Examples of the trivalent or higher polyamine (B2) include diethylenetriamine, and triethylene tetramine.

Examples of the amino alcohol (B3) include ethanol amine, and hydroxyethyl aniline.

Examples of the amino mercaptan (B4) include aminoethylmercaptan, and aminopropylmercaptan.

Examples of the amino acid (B5) include amino propionic acid, and amino caproic acid.

Examples of the product (B6) obtained by blocking an amino group of any of B1 to B5 include a ketimine compound and oxazoline compound obtained from any of the amines B1 to B5 and ketones (e.g., acetone, methyl ethyl ketone, and methyl isobutyl ketone).

Among these amines (B), B1 and a mixture of B1 and a small amount of B2 are preferable.

A molecular weight of the modified polyester after completing reaction can be adjusted using a crosslink and/or elongation terminating agent.

Examples of the terminating agent include monoamines (e.g., diethylamine, dibutylamine, butylamine, and laurylamine), and a product obtained by blocking any of the monoamines (e.g., a ketimine compound).

A ratio of the amines (B), as the equivalent ratio [NCO]/[NHx] of isocyanate group [NCO] in the polyester prepolymer (A) having isocyanate group to amino group [NHx] in the amines (B), is preferably 1/2 to 2/1, more preferably 1.5/1 to 1/1.5, still more preferably 1.2/1 to 1/1.2. When [NCO]/[NHx] is within a range of 1/2 to 2/1, the molecular weight of the urea-modified polyester (i) is appropriate, and the toner is excellent in hot offset resistance.

—Unmodified Polyester Resin—

The unmodified polyester resin is a polyester resin that is obtained by using a polyhydric alcohol, and a multivalent carboxylic acid or derivatives thereof such as a multivalent carboxylic acid, a multivalent carboxylic acid anhydride, and a multivalent carboxylic acid ester, and that is not modified by an isocyanate compound and the like.

Examples of the polyhydric alcohol include

The diol include alkylene (having 2 to 3 carbon atoms) oxide (average addition molar number is 1 to 10) adduct of bisphenol A such as polyoxypropylene(2.2)-2,2-bis(4-hydroxyphenyl)propane, and polyoxyethylene(2.2)-2,2-bis(4-hydroxyphenyl)propane; ethylene glycol, propylene glycol; and hydrogenated bisphenol A, and alkylene (having 2 to 3 carbon atoms) oxide (average addition molar number is 1 to 10) adduct of hydrogenated bisphenol A. These may be used alone or in combination thereof.

Examples of the multivalent carboxylic acid include dicarboxylic acid.

Examples of the dicarboxylic acid include: adipic acid, phthalic acid, isophthalic acid, terephthalic acid, fumaric acid, maleic acid; and succinic acid substituted by an alkyl group having 1 to 20 carbon atoms or an alkenyl group having 2 to 20 carbon atoms such as dodecenylsuccinic acid and octylsuccinic acid. These may be used alone or in combination thereof.

The unmodified polyester may contain at least one of a trivalent or higher carboxylic acid and a trihydric or higher alcohol at the end of the resin chain in order to adjust an acid value and a hydroxyl value.

Examples of the trivalent or higher carboxylic acid include trimellitic acid, pyromellitic acid, and acid anhydride thereof.

Examples of the trihydric or higher alcohol include glycerin, pentaerythritol, and trymethylol propane.

A molecular weight of the unmodified polyester is not particularly limited and may be appropriately selected depending on the intended purpose. However, when the molecular weight thereof is too low, heat resistant storage stability of the toner and durability against stress such as stirring in the developing unit may be deteriorated. When the molecular weight thereof is too high, viscoelasticity of the toner during melting may be high, and thus low temperature fixing ability of the toner may be deteriorated. Thus, the weight average molecular weight (Mw) of the unmodified polyester is preferably 3,000 to 10,000 as measured by GPC (gel permeation chromatography). A number average molecular weight (Mn) of the unmodified polyester is preferably 1,000 to 4,000.

Moreover, a Mw/Mn of the unmodified polyester is preferably 1.0 to 4.0.

The weight average molecular weight (Mw) thereof is more preferably 4,000 to 7,000. The number average molecular weight (Mn) thereof is more preferably 1,500 to 3,000. The Mw/Mn thereof is more preferably 1.0 to 3.5.

An acid value of the unmodified polyester is not particularly limited and may be appropriately selected depending on the intended purpose, but it is preferably 1 mg KOH/g to 50 mg KOH/g, more preferably 5 mg KOH/g to 30 mg KOH/g. When the acid value thereof is 1 mg KOH/g or more, the resultant toner may be negatively charged. In addition, the resultant toner has good affinity between paper and the toner when fixed on the paper, and thus low temperature fixing ability of the toner may be improved. When the acid value thereof is 50 mg KOH/g or less, the resultant toner may be excellent in charging stability, especially charging stability against environmental change.

A hydroxyl value of the unmodified polyester is not particularly limited and may be appropriately selected depending on the intended purpose. The hydroxyl value thereof is preferably 5 mg KOH/g or more.

A glass transition temperature (Tg) of the unmodified polyester is not particularly limited and may be appropriately selected depending on the intended purpose, but it is preferably 40° C. to 70° C. A molecular structure of the unmodified polyester can be confirmed by solution-state or solid-state NMR, X-ray diffraction, GC/MS, LC/MS, or IR spectroscopy. Simple methods for confirming the molecular structure thereof include a method for detecting, as a non-crystalline polyester resin, one that does not have absorption based on δCH (out-of-plane bending vibration) of olefin at 965 $cm^{-1}$±10 $cm^{-1}$ and 990 $cm^{-1}$±10 $cm^{-1}$ in an infrared absorption spectrum.

<Colorant>

The colorant is not particularly limited and may be appropriately selected depending on the intended purpose. Examples of thereof include carbon black, a nigrosin dye, iron black, naphthol yellow S, Hansa yellow (10G, 5G and G), cadmium yellow, yellow iron oxide, yellow ocher, yellow lead, titanium yellow, polyazo yellow, oil yellow, Hansa yellow (GR, A, RN and R), pigment yellow L, benzidine yellow (G and GR), permanent yellow (NCG), vulcan fast yellow (5G and R), tartrazine lake, quinoline yellow lake, anthrasan yellow BGL, isoindolinon yellow, red iron oxide, red lead, lead vermilion, cadmium red, cadmium mercury red, antimony vermilion, permanent red 4R, parared, fiser red, parachloroorthonitro anilin red, lithol fast scarlet G, brilliant fast scarlet, brilliant carmine BS, permanent red (F2R, F4R, FRL, FRLL and F4RH), fast scarlet VD, vulcan fast rubin B, brilliant scarlet G, lithol rubin GX, permanent red FSR, brilliant carmine 6B, pigment scarlet 3B, Bordeaux 5B, toluidine Maroon, permanent Bordeaux F2K, Helio Bordeaux BL, Bordeaux 10B, BON maroon light, BON maroon medium, eosin lake, rhodamine lake B, rhodamine lake Y, alizarin lake, thioindigo red B, thioindigo maroon, oil red, quinacridone red, pyrazolone red, polyazo red, chrome vermilion, benzidine orange, perinone orange, oil orange, cobalt blue, cerulean blue, alkali blue lake, peacock blue lake, Victoria blue lake, metal-free phthalocyanine blue, phthalocyanine blue, fast sky blue, indanthrene blue (RS and BC), indigo, ultramarine, iron blue, anthraquinone blue, fast violet B, methyl violet lake, cobalt purple, manganese violet, dioxane violet, anthraquinone violet, chrome green, zinc green, chromium oxide, viridian, emerald green, pigment green B, naphthol green B, green gold, acid green lake, malachite green lake, phthalocyanine green, anthraquinone green, titanium oxide, zinc flower, and lithopone. These may be used alone or in combination thereof.

An amount of the colorant is not particularly limited and may be appropriately selected depending on the intended purpose, but it is preferably 1 part by mass to 15 parts by mass, more preferably 3 parts by mass to 10 parts by mass, relative to 100 parts by mass of the toner.

The colorant may be used in the form of a master batch in which it is combined with a resin. Examples of the resin used in the production of the master batch or the resin kneaded together with the master batch include, in addition to the polyester resins, styrene polymers or substituted products thereof (e.g., polystyrene, poly-p-chlorostyrene, and polyvinyl toluene); styrene-based copolymer (e.g., styrene-p-chlorostyrene copolymer, styrene-propylene copolymer, styrene-vinyl toluene copolymer, styrene-vinyl naphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-methyl $\alpha$-chloromethacrylate copolymer, styrene-acrylonitrile copolymer, styrene-methyl vinyl ketone copolymer, styrene-butadiene copolymer, styrene-isoprene copolymer, styrene-acrylonitrile-indene copolymer, styrene-maleic acid copolymer, and styrene-maleic acid ester copolymer); and others such as polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid resin, rosin, modified rosin, terpene resin, aliphatic or alicyclic hydrocarbon resin, aromatic petroleum resin, chlorinated paraffin, and paraffin wax. These may be used alone or in combination thereof.

It is possible to obtain the master batch by mixing and kneading the colorant with the resin for the master batch under a high shearing force. In the mixing and kneading, an organic solvent may be used for improving the interactions between the colorant and the resin. Moreover, a flashing method of mixing and kneading an aqueous paste of the colorant containing water with the resin and an organic solvent, transferring the colorant to the resin, and removing the water and the organic solvent is preferably used, because it is possible to use the resulting wet cake of the colorant as it is, without drying it. In the mixing and kneading, a high-shearing disperser such as a three-roll mill is preferably used.

<Release Agent>

As the release agent, a wax containing a hydrocarbon compound having 33 to 35 carbon atoms in an amount of 40% to 70% of the signal intensity ratio, as evaluated by the on attachment mass spectrometry (IAMS) is preferable.

Examples of the wax include polyolefin wax (e.g., polyethylene wax and polypropylene wax); long-chain hydrocarbon (e.g., paraffin wax and SASOL wax); and carbonyl group-containing wax. Among them, carbonyl group-containing wax is preferable.

Examples of the carbonyl group-containing wax include polyalkanoic acid ester (e.g., carnauba wax, montan wax, trimethylolpropane tribehenate, pent aerythritol tetrabehenate, pentaerythritol diacetate dibehenate, glycerin tribehenate and 1,18-octadecanediol distearate); polyalkanol ester (e.g., tristearyl trimellitate and distearyl maleate); polyalkanoic acid amide (e.g., ethylenediamine dibehenylamide); polyalkylamide (e.g., trimellitic acid tristearylamide); and dialkyl ketone (e.g., distearyl ketone). Among them, polyalkanoic acid ester is preferred.

A melting point of the wax is preferably 40° C. to 160° C., more preferably 50° C. to 120° C., still more preferably 60° C. to 90° C. When the melting point thereof is 40° C. or more, the toner is excellent in heat resistant storage stability. When it is 160° C. or less, the toner can be prevented from causing cold offset during fixing at low temperature.

A melt viscosity of the wax is preferably 5 cps to 1,000 cps, more preferably 10 cps to 100 cps, as measured at a temperature higher by 20° C. than the melting point. When the melt viscosity thereof is 1,000 cps or less, the toner is improved in hot offset resistance and low temperature fixing ability.

An amount of the wax in the toner is preferably 40% by mass or less, more preferably 3% by mass to 30% by mass.

It is preferred that the wax is subjected to purification (distillation) so that the total amount of the hydrocarbon compounds having 33 to 35 carbon atoms in the release agent evaluated by ion attachment mass spectrometry (IAMS) is 40% to 70% in terms of the signal intensity ratio. As a method of the distillation, a thin-film distillation method (falling-down film distillation method and centrifugal distillation method) are more preferable.

<Other Components>

Examples of the aforementioned other components include an external additive, a charge controlling agent, a flow improving agent, a cleaning improving agent, a magnetic material, and fine resin particle.

—External Additive—

As for the external additive, other than oxide particles, a combination of inorganic particles and hydrophobic-treated inorganic particles can be used. The average particle diameter of primary particles of the hydrophobic-treated particles is preferably 1 nm to 100 nm, and more preferable 5 nm to 70 nm.

Moreover, it is preferred that the external additive contain at least one type of hydrophobic-treated inorganic particles having the average particle diameter of primary particles of 20 nm or less, and at least one type of inorganic particles having the average particle diameter of primary particles of 30 nm or more. Moreover, the external additive preferably has the BET specific surface area of 20 $m^2/g$ to 500 $m^2/g$.

The external additive is not particularly limited and may be appropriately selected depending on the intended purpose. Examples thereof include silica particles, hydrophobic silica, fatty acid metal salts (e.g., zinc stearate, and aluminum stearate), metal oxide (e.g., titania, alumina, tin oxide, and antimony oxide), and a fluoropolymer.

Examples of the suitable additive include hydrophobic silica, titania, titanium oxide, and alumina particles. Examples of the silica particles include R972, 11974, RX200, RY200, R202, R805, and R812 (all products of Nippon Aerosil Co., Ltd.). Examples of the titania particles include P-25 (product of Nippon Aerosil Co., Ltd.); STT-30, STT-65C-S (both products of Titan Kogyo, Ltd.); TAF-140 (product of Fuji Titanium Industry Co., Ltd.); and MT-150 W, MT-500B, MT-600B, MT-150A (all products of TAYCA CORPORATION).

Examples of the hydrophobic-treated titanium oxide particles include: T-805 (product of Nippon Aerosil Co., Ltd.); STT-30A, STT-65S-S (both products of Titan Kogyo, Ltd.); TAF-500T, TAF-1500T (both products of Fuji Titanium Industry Co., Ltd.); MT-100S, MT-100T (both products of TAYCA CORPORATION); and IT-S (product of ISHIHARA SANGYO KAISHA, LTD.).

The hydrophobic-treated oxide particles, hydrophobic-treated silica particles, hydrophobic-treated titania particles, and hydrophobic-treated alumina particles can be obtained, for example, by treating hydrophilic particles with a silane coupling agent, such as methyltrimethoxy silane, methyltriethoxy silane, and octyltrimethoxy silane. Moreover, silicone oil-treated oxide particles, or silicone oil-treated inorganic particles, which have been treated by adding silicone oil optionally with heat, are also suitably used as the external additive.

Examples of the silicone oil include dimethyl silicone oil, methylphenyl silicone oil, chlorophenyl silicone oil, methyl hydrogen silicone oil, alkyl-modified silicone oil, fluorine-modified silicone oil, polyether-modified silicone oil, alcohol-modified silicone oil, amino-modified silicone oil, epoxy-modified silicone oil, epoxy-polyether-modified silicone oil, phenol-modified silicone oil, carboxyl-modified silicone oil, mercapto-modified silicone oil, methacryl-modified silicone oil, and α-methylstyrene-modified silicone oil.

Examples of the fine inorganic particles include silica, alumina, titanium oxide, barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, colcothar, antimony trioxide, magnesium oxide, zirconium oxide, barium sulfate, barium carbonate, calcium carbonate, silicon carbide, and silicon nitride. Among these, silica and titanium dioxide are particularly preferable.

An amount of the external additive is not particularly limited and may be appropriately selected depending on the intended purpose, but it is preferably 0.1 parts by mass to 5 parts by mass, more preferably 0.3 parts by mass to 3 parts by mass, relative to 100 parts by mass of the toner.

The average particle diameter of primary particles of the inorganic particles is not particularly limited and may be appropriately selected depending on the intended purpose, but it is preferably 100 nm or less, more preferably 3 nm to 70 nm.

—Charge Controlling Agent—

The charge controlling agent is not particularly limited and may be appropriately selected depending on the intended purpose. Examples thereof include nigrosine dyes, triphenylmethane dyes, chrome-containing metal complex dyes, molybdic acid chelate pigments, rhodamine dyes, alkoxy amines, quaternary ammonium salts (including fluorine-modified quaternary ammonium salts), alkylamides, phosphorus, phosphorus compounds, tungsten, tungsten compounds, fluorine active agents, metal salts of salicylic acid, and metal salts of salicylic acid derivatives.

Specific examples of the charge controlling agent include nigrosine dye BONTRON 03, quaternary ammonium salt BONTRON P-51, metal-containing azo dye BONTRON S-34, oxynaphthoic acid-based metal complex E-82, salicylic acid-based metal complex E-84, and phenol condensate E-89 (all products of Orient Chemical Industries Co., Ltd.); quaternary ammonium salt molybdenum complex TP-302 and TP-415 (all products of Hodogaya Chemical Co., Ltd.); LRA-901; and boron complex LR-147 (products of Japan Carlit Co., Ltd.); copper phthalocyanine; perylene; quinacridone; azo-pigments; and polymeric compounds having a functional group, such as a sulfonic acid group, carboxyl group, quaternary ammonium salt, etc.

An amount of the charge controlling agent is not particularly limited and may be appropriately selected depending on the intended purpose, but it is preferably 0.1 parts by mass to 10 parts by mass, more preferably 0.2 parts by mass to 5 parts by mass, relative to 100 parts by mass of the toner. When the amount thereof is 10 parts by mass or less, the charging ability of the toner is appropriate, the effect of the charge controlling agent can be obtained, electrostatic force to a developing roller may be appropriate, low flowability of the developer is improved, and low image density of the resulting image becomes high. These charge controlling agents may be dissolved and dispersed after being melted and kneaded together with the master batch, and/or resin. The charge controlling agents can be, of course, directly added to an organic solvent when dissolution and dispersion is performed. Alternatively, the charge controlling agents may be fixed on surfaces of toner particles after the production of the toner particles.

—Flowability Improving Agent—

The flowability improving agent is not particularly limited and may be appropriately selected depending on the intended purpose so long as it is capable of performing surface treatment of the toner to increase hydrophobicity, and preventing degradations of flow properties and charging properties of the toner even in a high humidity environment. Examples thereof include a silane-coupling agent, a sililation agent, a silane-coupling agent containing a fluoroalkyl group, an organic titanate-based coupling agent, an aluminum-based coupling agent, silicone oil, and modified silicone oil. It is particularly preferred that the silica or the titanium oxide be used as hydrophobic silica or hydrophobic titanium oxide treated with the aforementioned flow improving agent.

—Cleanability Improving Agent—

The cleanability improving agent is not particularly limited and may be appropriately selected depending on the intended purpose so long as it can be added to the toner for the purpose of removing the developer remaining on a photoconductor or a primary transfer member after transferring. Examples thereof include; fatty acid metal salt such as zinc stearate, calcium stearate, and stearic acid; and polymer particles produced by soap-free emulsion polymerization, such as polymethyl methacrylate particles, and polystyrene particles. The polymer particles are preferably those having a relatively narrow particle size distribution, and the polymer particles having the volume average particle diameter of 0.01 μm to 1 μm are preferably used.

—Magnetic Material—

The magnetic material is not particularly limited and may be appropriately selected depending on the intended purpose. Examples thereof include iron powder, magnetite, and ferrite. Among them, a white magnetic material is preferable in terms of a color tone.

The toner is preferably produced by a method for producing the toner, the method including performing granulation in a medium containing at least one of water and an organic solvent. This is more preferable from the viewpoints of controlling a state where the release agent exists. Generally, when the ground toner obtained by a melt-kneading method is exposed to a high-temperature environment during production, a dispersion state and a crystal structure of the release agent are changed by heat and stress, and thus are difficult to control, which is problematic.

The toner is preferably produced by a dissolution suspension method. The toner produced by a dissolution suspension method can be designed to have low temperature fixing ability, and a shape of particle, which influences flowability on the toner, can be controlled. Therefore, charging stability of the toner can be retained under high temperature and high humidity.

The toner is preferably produced by a dissolution suspension method accompanied with elongation reaction. When the toner is produced by the above method, allowance of designing low temperature fixing ability increases, and a shape of particle, which influences flowability on the toner, can be controlled. Therefore, charging ability of the toner can be prevented from decreasing.

The toner can be preferably formed by reacting a toner composition with an aqueous medium through an elongation reaction or a cross-linking reaction in the presence of the fine resin particles, where the toner composition contains a polymer including a portion capable of reacting with a compound that contains an active hydrogen group, a crystalline polyester resin, an unmodified polyester resin, a colorant, and a release agent. As a result, the fine resin particles function as a particle diameter controlling agent, are arranged around the toner, and finally cover the surface of the toner to form a shall layer. Thus, the toner having a core-shell structure can be formed.

—Fine Resin Particle—

The fine resin particle is not particularly limited and may be appropriately selected depending on the intended purpose. Examples thereof include a vinyl resin, a polyurethane resin, an epoxy resin, a polyester resin, a polyamide resin, a polyimide resin, a silicone resin, a phenol resin, a melamine resin, a urea resin, an aniline resin, an iomer resin, and a polycarbonate resin. Among them, a vinyl resin, a polyurethane resin, an epoxy resin, a polyester resin, and any combination thereof are preferable, and a vinyl resin is particularly preferable, because a water dispersion having fine spherical resin particles can be easily obtained.

The vinyl resin is a polymer obtained by homopolymerizing or copolymerizing a vinyl monomer. Examples thereof include a styrene-(meth)acrylate ester resin, a styrene-butadiene copolymer, a (meth)acrylic acid-acrylate ester polymer, a styrene-acrylonitrile copolymer, a styrene-maleic anhydride copolymer, and a styrene-(meth)acrylic acid copolymer.

As the fine resin particle, a copolymer containing a monomer that includes at least two unsaturated groups can be used.

The monomer that includes at least two unsaturated groups is not particularly limited and may be appropriately selected depending on the intended purpose. Examples thereof include sodium salt of methacrylic acid-ethylene oxide adduct sulfate ester ("ELEMINOL RS-30", product of Sanyo Chemical Industries, Ltd.), divinylbenzene, and 1,6-hexanediol acrylate.

A glass transition temperature (Tg) of the fine resin particle is not particularly limited and may be appropriately selected depending on the intended purpose, but it is preferably 40° C. to 100° C. When the glass transition temperature (Tg) thereof is 40° C. or more, the toner is excellent in storage property, and can be prevented from causing blocking in a developing device during storage. When the glass transition temperature (Tg) thereof is 100° C. or less, the fine resin particle is excellent in adhesive property with a fixing paper, which leads to appropriate minimum fixing temperature.

Here, the glass transition temperature can be measured as follows using TG-DSC system TAS-100 (product of Rigaku Corporation). First, 10 mg of a sample is charged into an aluminum sample container, and the sample container is placed on a holder unit, which is set in an electric furnace. The sample is heated to 150° C. from room temperature at the heating rate of 10° C./min, is left to stand at 150° C. for 10 minutes, is cooled to room temperature, and is left to stand for 10 minutes. Then, the sample is heated to 150° C. at the heating rate of 10° C./min in the nitrogen atmosphere, and DSC curves are measured using a differential scanning calorimeter (DSC). Using the obtained DSC curves and an analysis system of TG-DSC system TAS-100, the glass transition temperature (Tg) can be determined by obtaining a contact point of a tangent of an endothermic peak present near the glass transition temperature (Tg) with a baseline.

A weight average molecular weight of the fine resin particle is not particularly limited and may be appropriately selected depending on the intended purpose, but it is preferably 3,000 to 300,000. When the weight average molecular weight thereof is 3,000 or more, the toner is excellent in storage property, and can be prevented from causing blocking in a developing device during storage. When the weight average molecular weight thereof is 300,000 or less, the fine resin particle is excellent in adhesive property with a fixing paper, which leads to appropriate minimum fixing temperature.

A residual rate of the fine resin particle in the toner is not particularly limited and may be appropriately selected depending on the intended purpose, but it is preferably 0.5% by mass to 5.0% by mass. When the residual rate thereof is 0.5% by mass or more, the toner is excellent in storage property, and can be prevented from causing blocking in a developing device during storage. The residual rate thereof is 5.0% by mass or less, the fine resin particle does not prevent a wax from bleeding, an releasing effect of the wax is appropriate, and offset does not occur.

The residual rate of the resin particles can be measured by analyzing a material that is not derived from the toner particles but is derived from the resin particles, by a pyrolysis gas chromatograph mass spectrometer, to thereby calculate the residual rate from a peak area. A detector is not particularly limited, but a mass spectrometer is preferable.

A volume average particle diameter of the fine resin particle is not particularly limited and may be appropriately selected depending on the intended purpose, but it is preferably 120 nm to 670 nm, more preferably 200 nm to 600 nm. The volume average particle diameter thereof is 120 nm or more, a thickness of a shell layer is appropriate, and thus a core-shell structure can be sufficiently formed. When the volume average particle diameter thereof is 670 nm or less, a thickness of a shell layer is appropriate, and thus the toner is excellent in low temperature fixing ability.

The volume average particle diameter can be measured by, for example, a particle size distribution measuring apparatus (LA-920, product of HORIBA, Ltd.).

<Method for Producing Toner>

A method for producing the toner is not particularly limited and may be appropriately selected depending on the intended purpose. The toner can be produced by reacting a toner composition with an aqueous medium through an elongation reaction or a cross-linking reaction in the presence of the fine resin particles, where the toner composition contains a polymer including a portion capable of reacting with a compound that contains an active hydrogen group, a crystalline polyester resin, an unmodified polyester resin, colorant, and a release agent.

Specifically, polyol (1) and polycarboxylic acid (2) are heated to 150° C. to 280° C. in the presence of an esterification catalyst such as tetrabutoxy titanate and dibutyltin oxide, and water generated is removed while reducing pressure, to thereby obtain a polyester having the hydroxyl group. Next, the polyester is allowed to react with polyisocyanate (3) at 40° C. to 140° C., to produce polyester prepolymer (A) having the isocyanate group.

The fine resin particle is added to the aqueous medium in advance. As water used for the aqueous medium, water may be used alone, or may be used in combination with a solvent capable of being mixed with water. Examples of the solvent capable of being mixed with water include alcohol (e.g., methanol, isopropanol, and ethylene glycol), dimethylformamide, tetrahydrofuran, cellosolves (e.g., methyl cellosolve), and lower ketones (e.g., acetone and methyl ethyl ketone).

An amount of the fine resin particle added to the aqueous medium is not particularly limited and may be appropriately selected depending on the intended purpose, but it is preferably 0.5% by mass to 10% by mass.

The toner can be obtained by reacting a dispersion with amines (B), where the dispersion contains of polyester prepolymer (A) having the isocyanate group dissolved or dispersed in an organic solvent that is an aqueous medium. As a method for stably forming the dispersion containing the polyester prepolymer (A) in an aqueous phase, a composition of toner materials is added to an aqueous phase, and is dispersed through application of shearing force, where the toner materials contains of the polyester prepolymer (A) dissolved or dispersed in an organic solvent. The polyester prepolymer (A) dissolved or dispersed in an organic solvent and another toner composition (hereinafter, referred to as "toner materials") such as a colorant, a colorant master batch, a release agent, a charge controlling agent, a crystalline polyester resin, and a unmodified polyester resin may be mixed when the dispersion is formed in the aqueous phase. However, it is preferable that the toner materials mixed in advance be dissolved or dispersed in an aqueous solvent, and then the resultant mixture be added to an aqueous medium, followed by dispersing the mixture. Moreover, in the present invention, the another toner materials such as a colorant, a release agent, a charge controlling agent, a crystalline polyester resin, and a unmodified polyester resin are not necessarily mixed when particles are formed in the aqueous phase, the another toner materials may be added thereto after forming particles. For example, a colorant can be added by a known dying method after forming particles containing no colorant.

The dispersing method is not particularly limited and may be appropriately selected depending on the intended purpose. As the dispersing method, publicly-known equipment such as a low speed shearing system, a high speed shearing system, a friction system, a high-pressure jetting system, and an ultrasonic wave system are applicable. A high speed shearing system is preferable in order to obtain a dispersion having a particle diameter of 2 μm to 20 μm. When a high speed shearing disperser is used, the rotation speed thereof is not particularly limited, but is typically 1,000 rpm to 30,000 rpm, and preferably 5,000 rpm to 20,000 rpm. The dispersion time is not particularly limited, but is typically 0.1 minutes to 5 minutes, when the batch-wise is used. The temperature during the dispersing is typically 0° C. to 150° C. (under pressure), and preferably 40° C. to 98° C. A higher temperature is preferable because a viscosity of the dispersion containing the polyester prepolymer (A) will not grow in viscosity, and will be easily dispersed.

An amount of the aqueous phase used is preferably 50 parts by mass to 2,000 parts by mass, more preferably 100 parts by mass to 1,000 parts by mass, relative to 100 parts by mass of the toner composition containing the polyester prepolymer (A).

When the amount thereof is less than 50 parts by mass, the toner composition may be poorly dispersed therein, and toner particles having a desired particle diameter may not be obtained. The amount thereof is more than 2,000 parts by mass, which is not economical. Moreover, a dispersing agent can be used if necessary. The dispersing agent is preferable because using dispersing agent makes the particle size distribution sharp, and the toner composition can be stably dispersed in the aqueous medium.

The dispersing agent is not particularly limited and may be appropriately selected depending on the intended purpose. Examples thereof include a surfactant, a water-insoluble inorganic compound dispersing agent, and a polymer protective colloid. These may be used alone or in combination of two or more thereof. Among them, the surfactant is preferable.

The surfactant is not particularly limited and may be appropriately selected depending on the intended purpose. Examples thereof include an anionic surfactant, a cationic surfactant, a nonionic surfactant, and an amphoteric surfactant.

Examples of the anionic surfactant include alkyl benzene sulfonic acid salts, α-olefin sulfonic acid salts, and phosphoric acid esters. An anionic surfactant containing a fluoroalkyl group is preferable. Examples of the anionic surfactant containing a fluoroalkyl group include fluoroalkyl carboxylic acid having 2 to 10 carbon atoms or a metal salt thereof, disodium perfluorooctane sulfonyl glutamate, sodium 3-[ω-fluoroalkyl (having 6 to 11 carbon atoms)oxy)-1-alkyl (having 3 to 4 carbon atoms) sulfonate, sodium 3-[ω-fluoroalkanoyl (having 6 to 8 carbon atoms)-N-ethylamino]-1-propanesulfonate, fluoroalkyl (having 11 to 20 carbon atoms) carboxylic acid or a metal salt thereof, perfluoroalkylcarboxylic acid (having 7 to 13 carbon atoms) or a metal salt thereof, perfluoroalkyl (having 4 to 12 carbon atoms) sulfonate or a metal salt thereof, perfluorooctanesulfonic acid diethanol amide, N-propyl-N-(2-hydroxyethyl) perfluorooctanesulfone amide, perfluoroalkyl (having 6 to 10 carbon atoms)sulfoneamidepropyltrimethylammonium salt, a salt of perfluoroalkyl (having 6 to 10 carbon atoms)-N-ethylsulfonylglycin and monoperfluoroalkyl (having 6 to 16 carbon atoms) ethylphosphate ester. Examples of the commercial product of the surfactant containing the fluoroalkyl group include: SURFLON S-111, S-112, S-113 (all products of Asahi Glass Co., Ltd.); FLUORAD FC-93, FC-95, FC-98, FC-129 (all products of Sumitomo 3M Limited); UNIDYNE DS-101, DS-102 (all products of DAIKIN INDUSTRIES, LTD.); MEGAFAC F-110, F-120, F-113, F-191, F-812, F-833 (all products of DIC Corporation); EFTOP EF-102, 103, 104, 105, 112, 123A, 123B, 306A, 501, 201, 204 (all products of Mitsubishi Materials Electronic Chemicals Co., Ltd.); and FUTARGENT F-100, F-150 (all products of NEOS COMPANY LIMITED).

Examples of the cationic surfactant include an amine salt surfactant, a quaternary ammonium salt cationic surfactant, and a fluoroalkyl group-containing cationic surfactant. Examples of the amine salt surfactant include alkyl amine salts, amino alcohol fatty acid derivatives, polyamine fatty acid derivatives and imidazoline. Examples of the quaternary ammonium salt cationic surfactant include alkyltrimethyl ammonium salts, dialkyldimethylammonium salts, alkyl dimethyl benzyl ammonium salts, pyridinium salts, alkyl isoquinolinium salts and benzethonium chloride. Examples of the fluodoalkyl group-containing cationic surfactant include fluoroalkyl group-containing aliphatic primary or secondary amine acid, aliphatic quaternary ammonium salt such as a perfluoroalkyl (6 to 10 carbon atoms) sulfonic amide propyltrimethyl ammonium salts, benzalkonium salts, benzetonium chloride, pyridinium salts, and imidazolinium salts.

Examples of the commercial product of the cationic surfactant include: SURFLON S-121 (product of Asahi Glass Co., Ltd.); FLUORAD FC-135 (product of Sumitomo 3M Limited); UNIDYNE DS-202 (product of DAIKIN INDUSTRIES, LTD.); MEGAFAC F-150, F-824 (product of DIC Corporation); EFTOP EF-132 (product of Mitsubishi Materials Electronic Chemicals Co., Ltd.); and FUTARGENT F-300 (product of NEOS COMPANY LIMITED).

Examples of the nonionic surfactant include a fatty acid amide derivative, and a polyhydric alcohol derivative.

Examples of the amphoteric surfactant include alanine, dodecyl di(aminoethyl)glycine, di(octylaminoethyl)glycine and N-alkyl-N,N-dimethylammonium betaine.

The water-insoluble inorganic compound dispersing agent is not particularly limited and may be appropriately selected depending on the intended purpose. Examples thereof include tricalcium phosphate, calcium carbonate, titanium oxide, colloidal silica, and hydroxyapatite.

The polymer protective colloid is not particularly limited and may be appropriately selected depending on the intended purpose. Examples thereof include acids, (meth) acryl monomer containing the hydroxyl group, vinyl alcohol or ethers of vinyl alcohol, esters of compound containing vinyl alcohol and the carboxyl group, amide compounds or methylol compounds thereof, chlorides, homopolymer or copolymer containing a nitrogen atom or its heterocycle, polyoxyethylene, and celluloses.

Examples of the acids include acrylic acid, methacrylic acid, α-cyanoacrylic acid, α-cyanomethacrylic acid, itaconic acid, crotonic acid, fumaric acid, maleic acid, and maleic anhydride. Examples of the (meth)acryl monomer containing the hydroxyl group include β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethylene glycol monoacrylate, diethylene glycol monomethacrylate, glycerin monoacrylate ester, glycerin monomethacrylate ester, N-methylol acryl amide, and N-methylol methacryl amide. Examples of the vinyl alcohol or ethers of the vinyl alcohol include vinyl methyl ether, vinyl ethyl ether, and vinyl propyl ether. Examples of the esters of compound containing vinyl alcohol and the carboxyl group include vinyl acetate, vinyl propionate, and vinyl butyrate. Examples of the amide compounds or methylol compounds thereof include acryl amide, methacryl amide, diacetone acryl amide acid, or methylol compounds of the aforementioned amides. Examples of the chlorides include acrylic acid chloride and methacrylic acid chloride. Examples of the homopolymer or copolymer containing a nitrogen atom or its heterocycle include vinyl pyridine, vinyl pyrrolidone, vinyl imidazole, and ethylene imine. Examples of the polyoxyethylene include polyoxy ethylene, polyoxypropylene, polyoxy ethylene alkyl amine, polyoxypropylene alkyl amine, polyoxyethylene alkyl amide, polyoxypropylene alkyl amide, polyoxyethylene nonylphenyl ether, polyoxyethylene laurylphenyl ether, polyoxyethylene stearylphenyl ester, and polyoxyethylene nonylphenyl ester. Examples of the celluloses include methyl cellulose, hydroxyethyl cellulose, and hydroxypropyl cellulose.

When the dispersion is prepared, a dispersing stabilizer can be used.

The dispersing stabilizer is not particularly limited and may be appropriately selected depending on the intended purpose. Examples thereof include acids such as a calcium phosphate salt, and a compound that can be dissolved in alkali.

When the dispersing stabilizer is used, the calcium phosphate salt is dissolved using an acid (e.g., hydrochloric acid), and then can be removed from fine particles by a method by a washing method or a decomposing method with an enzyme.

When the dispersion is prepared, a catalyst for the elongation reaction or the cross-linking reaction can be used. Examples of the catalyst include dibutyl tin laurate and dioctyl tin laurate.

The organic solvent is removed from the obtained dispersion liquid (emulsified slurry). A method for removing the organic solvent is as follows: (1) a method where the entire reaction system is gradually heated to completely evaporate and remove the organic solvent in oil droplets; and (2) a method where an emulsified dispersion is sprayed in a dry atmosphere to completely remove a water-insoluble organic solvent in oil droplets, and to remove an aqueous dispersing agent by evaporation.

Once the organic solvent is removed, toner base particles are formed. The toner base particles can be subjected to washing, and drying, and can be further subjected to classification if necessary. The classification can be performed by removing fine particle portions by a cyclone, a decanter, or centrifugal separation in a solution. The classification operation can be performed after obtaining particles as a powder.

After that, it is more preferable that when the toner base particles are aged, a midair state of the inner toner can be controlled. An aging temperature is preferably 30° C. to 55° C., more preferably 40° C. to 50° C. An aging time is preferably 5 hours to 36 hours, more preferably 10 hours to 24 hours.

When toner base particles having a broaden particle size distribution during emulsifying and dispersing are subjected to a washing treatment and a drying treatment so as to retain the particle size distribution, they can be classified into a desired particle size distribution to adjust the particle size distribution.

The classification operation can be performed by removing fine particle portions by a cyclone, a decanter, or centrifugal separation in a solution. Of course, the toner particles may be dried to obtain powders thereof, and then the dried powder may be subjected to the classification operation. The classification operation, however, is preferably performed in a solution in terms of efficiency.

The thus-obtained toner particles are mixed with the colorant, the release agent, and the charge controlling agent, and a mechanical impact is further applied to the mixture, and thus the surface of the toner can be prevented from releasing particles (e.g., the release agent). As a method for applying the mechanical impact, a method where an impact is applied to the mixture using a blade that rotates at high speed; and a method where the mixture is accelerated into a high-speed air flow, and the speed is increased to crash the particles or composite particle to an appropriate impact board can be used.

A device used for the aforementioned methods is appropriately selected depending on the intended purpose without any limitation, and examples thereof include an angmill (product of Hosokawa Micron Corporation), a device the pulverization air pressure of which is reduced by modifying an I-type mill (product of NIPPON PNEUMATIC MFG. CO., LTD.), a hybridization system (product of NARA MACHINERY CO., LTD.), Cliptron System (product of Kawasaki Heavy Industries, Ltd.), and an automatic mortar.

<Shape of Toner>

A shape and a size of the toner are not particularly limited and may be appropriately selected depending on the intended purpose, but the toner preferably has the average circularity, the weight average particle diameter, and the ratio of the weight average particle diameter to the number average particle diameter (weight average particle diameter/number average particle diameter), as described below.

—Average Circularity—

The average circularity of the toner is preferably 0.93 to 0.99. The toner having an average circularity of 0.93 to 0.99 can be prevented from lowering charging ability under high humidity and high temperature.

The average circularity is defined as "(perimeter of a circle that has the same area as projected area of particle/perimeter of projected image of particle)×100%".

An average circularity can be measured by, for example, a flow type particle image analyzer ("FPIA-2100", product of SYSMEX CORPORATION), and analysis can be performed using an analysis software (FPIA-2100, Data Processing Program for FPIA version 00-10). Specifically, a 10% by mass surfactant (alkyl benzene sulfonate, NEOGENSC-A, product of DKS Co. Ltd.) (0.1 mL to 0.5 mL) is added to a 100 mL-glass beaker, and the toner (0.1 g to 0.5 g) is added thereto. Then, the mixture is stirred by a micro-spatula, followed by adding 80 mL of ion-exchanged water thereto. The obtained dispersion liquid is subjected to the dispersion treatment for 3 minutes by an ultrasonic wave disperser (HONDA ELECTRONICS CO., LTD.). A concentration of the dispersion liquid is adjusted to 5,000 particles/μL to 15,000 particles/μL, and a shape and a distribution of the dispersion liquid are measured using the FPIA-2100.

In the present method, it is important that a concentration of the dispersion liquid is adjusted to 5,000 particles/μL to 15,000 particles/μL, in terms of measurement reproducibility of the average circularity. In order to obtain the aforementioned concentration of the dispersion liquid, conditions of obtaining the dispersion liquid, i.e., an amount of the surfactant to be added to the dispersion liquid, and an amount of the toner are necessarily changed. A requisite amount of the surfactant is different depending on hydrophobicity of the toner. When the surfactant is excessively added thereto, forming may cause noise. When the surfactant is slightly added thereto, it does not wet the toner, and thus dispersion may be insufficient. An amount of the toner added is different depending on a particle diameter. When the particle diameter is small, an amount of the surfactant is slightly added to the toner. When the particle diameter is large, it is necessary to excessively add the surfactant to the toner. When mass average particle diameter of the toner is 2 μm to 7 μm, a concentration of the dispersion liquid can be adjusted to 5,000 particles/μL to 15,000 particles/μL by adding 0.1 g to 0.5 g of the surfactant.

—Weight Average Particle Diameter, and Weight Average Particle Diameter/Number Average Particle Diameter—

A weight average particle diameter $D_4$ of the toner is preferably 2 μm to 7 μm, more preferably 2 μm to 5 μm. A ratio ($D_4/D_n$) of the weight average particle diameter ($D_4$) to the number average particle diameter ($D_n$) is preferably 1.00 to 1.25, more preferably 1.00 to 1.15. The toner having the aforementioned values is prevented from poor charging ability under high temperature and high humidity.

The weight average particle diameter ($D_4$), the number average particle diameter ($D_n$), and the ratio therebetween ($D_4/D_n$) of the toner can be measured using, for example, Coulter Counter TA-II or Coulter Multisizer II (these products are of Coulter, Inc.).

In the present invention, Coulter Multisizer II was used. The measurement method is as follows.

First, a surfactant (0.1 mL to 5 mL), preferably a polyoxyethylene alkyl ether (nonionic surfactant), is added as a dispersing agent to an aqueous electrolyte solution (100 mL to 150 mL). Here, the aqueous electrolyte solution is an about 1% by mass aqueous NaCl solution prepared using 1st grade sodium chloride, and ISOTON-II (product of Coulter, Inc.) can be used as the aqueous electrolyte solution. Next, a measurement sample in an amount of 2 mg to 20 mg is added therein.

The resultant aqueous electrolyte solution in which the sample has been suspended is dispersed with an ultrasonic wave disperser for about 1 min to about 3 min. The thus-obtained dispersion liquid is analyzed with the above-described apparatus using an aperture of 100 μm to measure the number or weight of the toner particles (or toner). Then, the weight particle size distribution $D_4$ and the number particle size distribution $D_n$ are calculated from the obtained values.

From these distributions, the weight average particle diameter ($D_4$) and the number average particle diameter ($D_n$) of the toner can be obtained. In this measurement, 13 channels are used: 2.00 μm (inclusive) to 2.52 μm (exclusive); 2.52 μm (inclusive) to 3.17 μm (exclusive); 3.17 μm (inclusive) to 4.00 μm (exclusive); 4.00 μm (inclusive) to 5.04 μm (exclusive); 5.04 μm (inclusive) to 6.35 μm (exclusive); 6.35 μm (inclusive) to 8.00 μm (exclusive); 8.00 μm (inclusive) to 10.08 μm (exclusive); 10.08 μm (inclusive) to 12.70 μm (exclusive); 12.70 μm (inclusive) to 16.00 μm (exclusive); 16.00 μm (inclusive) to 20.20 μm (exclusive); 20.20 μm (inclusive) to 25.40 μm (exclusive); 25.40 μm (inclusive) to 32.00 μm (exclusive); and 32.00 μm (inclusive) to 40.30 μm (exclusive); i.e., particles having a particle diameter of 2.00 μm (inclusive) to 40.30 μm (exclusive) were subjected to the measurement.

(Two-Component Developer)

A two-component developer of the present invention includes the toner of the present invention and a magnetic carrier. The two-component developer can appropriately ensure that the resultant toner has charging ability under high temperature and high humidity environment, and that contamination of the carrier by the release agent can be reduced, which can result in performing appropriate developing-transferring steps. As a result, a two component having high environmental stability (reliability) can be provided.

<Magnetic Carrier>

Examples of the magnetic carrier include iron powder, ferrite powder, magnetite powder, and resin-coated magnetic carrier, each having the average particle diameter of about 20 μm to about 200 μm. Among them, the resin-coated magnetic carrier is particularly preferable.

The coating resin is appropriately selected depending on the intended purpose without any limitation, and examples thereof include a urea-formaldehyde resin, a melamine resin, a benzoguanamine resin, a urea resin, a polyamide resin, an epoxy resin, a polyvinyl or polyvinylidene-based resin, an acrylic resin, a polymethyl methacrylate resin, polyacrylonitrile resin, a polyvinyl acetate resin, a polyvinyl alcohol resin, a polyvinyl butyral resin, a polystyrene resin, a styrene-acryl copolymer resin, a halogenated olefin resin (e.g., polyvinyl chloride), a polyester-based resin (e.g., polyethylene terephthalate resin, and polybutylene terephthalate), a polycarbonate-based resin, a polyethylene resin, a polyvinyl fluoride resin, a polyvinylidene fluoride resin, a polytrifluoroethylene resin, a polyhexafluoropropylene resin, a copolymer of vinylidene fluoride and an acryl monomer, a copolymer of vinylidene fluoride and vinyl fluoride, a fluoro terpolymer (e.g., a terpolymer of tetrafluoroethylene, vinylidene fluoride, and a non-fluoromonomer), and a silicone resin.

The coating resin may optionally contain a conductive powder. Examples of the conductive powder include a metal powder, carbon black, titanium oxide, tin oxide, and zinc oxide. The average particle diameter of the conductive powder is preferably 1 μm or smaller. When the average particle diameter thereof is 1 μm or smaller, electric resistance can be easily controlled.

A mass ratio of the magnetic carrier and toner in the two-component developer is appropriately selected depending on the intended purpose without any limitation, but the toner is preferably 1 part by mass to 10 parts by mass, relative to 100 parts by mass of the magnetic carrier.

<Process Cartridge>

The process cartridge used in the present invention includes at least an electrostatic latent image bearer configured to bear an electrostatic latent image, and a developing unit containing a toner and configured to develop the electrostatic latent image bearer born on the latent image bearer with the toner to form a visible image. The process cartridge may further contain appropriately selected other units, such as a charging unit, an exposing unit, a transfer unit, a cleaning unit, and a diselectrification unit, if necessary.

The developing unit contains at least a developer container configured to house the toner or the developer, and a developer bearing member configured to bear and transport the toner or developer housed in the developer container, and may further contain a layer thickness regulating member configured to regulate a toner layer thickness born on the developer bearing member. Specifically, either a one-component developing unit or a two-component developing unit explained in the image forming apparatus and image forming method described below can be suitably used.

Moreover, the charging unit, exposing unit, transfer unit, cleaning unit, and diselectrification unit are appropriately selected from those similar to units in the image forming apparatus described hereinafter.

The process cartridge can be detachably mounted in various electrophotographic image forming apparatuses, facsimiles, and printers. It is particularly preferred that the process cartridge be detachably mounted in the color-image forming apparatus of the present invention.

Here, the process cartridge, as illustrated in FIG. 1 for example, includes an electrostatic latent image bearer 101, a charging unit 102, a developing unit 104, a transfer unit 108, and a cleaning unit 107, and may further include other units, if necessary. In FIG. 1, 103 means exposure by an exposing unit, and 105 means a recording medium.

An image forming process performed by the process cartridge illustrated in FIG. 1 will be described hereinafter. An electrostatic latent image corresponding to an exposure image is formed on a surface of the electrostatic latent image bearer 101 by charging by the charging unit 102, and exposure 103 by an exposing unit (not illustrated) with rotating the electrostatic latent image bearer 101 in the direction depicted with the arrow. This electrostatic latent image is developed by the developing unit 104 to obtain a visible image, and the obtained visible image is transferred onto the recording medium 105 by the transfer unit 108, followed by printing out. Subsequently, the surface of the latent image bearer after transferring the image is cleaned by the cleaning unit 107, and is charge-eliminated by a charge-eliminating unit (not illustrated). Then, the aforementioned operations are repeated.

(Color-Image Forming Apparatus and Color Image Forming Method)

A color-image forming apparatus of the present invention includes at least an electrostatic latent image bearer, a charging unit, an exposing unit, a developing unit, a transfer unit, a fixing unit, and a cleaning unit, and may further include appropriately selected other units, if necessary. Note that, the charging unit and the exposing unit may be collectively referred to as an electrostatic latent image forming unit.

A color image forming method used in the present invention includes a charging step, an exposing step, a developing step, a transferring step, a fixing step, and a cleaning step, and further includes other steps, if necessary. Note that, the charging step and the exposing step may be collectively referred to as an electrostatic latent image forming step as a single step.

The color image forming method used in the present invention can be suitably performed by the color-image forming apparatus of the present invention. The charging step can be performed by the charging unit, the exposing step can be performed by the exposing unit, the developing step can be performed by the developing unit, the transferring step can be performed by the transfer unit, the fixing step can be performed by the fixing unit, the cleaning step can be performed by the cleaning unit, and the aforementioned other steps can be performed by the aforementioned other units.

An image forming apparatus includes a fixing device configured to fix a visible image with heat and compression, where the visible image is formed on a recording medium using the toner. The image forming apparatus is a tandem developing system including at least four developing units having different developing colors disposed in series, a print speed thereof is 200 mm/sec to 3,000 mm/sec, a contact pressure by a fixing member is 10 N/cm$^2$ to 3,000 N/cm$^2$, and a fixing nip time is 30 msec to 400 msec. As a result, flowability of the toner can be appropriately ensured in the high speed region of the print speed, and developing, transferring, and fixing can be performed without contamination to the fixing member. Moreover, deformation of the toner can be appropriately performed under pressure, melting and fixing the toner on the recording medium can be controlled, hot offset is not caused. In addition, the fixing nip time is appropriately set, and thus a color-image forming apparatus can be provided, where the color-image forming apparatus configured to control heat quantity necessary for fixing the toner, configured to consume a small amount of electricity, and configured to ensure appropriate image quality.

<Electrostatic Latent Image Bearer>

A material, a shape, a structure, and a size of the electrostatic latent image bearer (may be referred to as an "electrostatic latent image bearer," "electrophotographic photoconductor," or "photoconductor" hereinafter) are appropriately selected from those known in the art without any limitation. Examples of the shape of the electrostatic latent image bearer include a drum shape, and a belt shape. Examples of the material of the electrostatic latent image bearer include an inorganic photoconductor (e.g., amorphous silicon, and selenium), and an organic photoconductor (OPC) (e.g., polysilane, and phthalopolymethine).

<Charging Step and Charging Unit>

The charging step is a step including charging a surface of the electrostatic latent image bearer, and is performed by the charging unit.

For example, the charging can be performed by applying a voltage to a surface of the electrostatic latent image bearer using the charging unit.

The charging unit is appropriately selected depending on the intended purpose without any limitation, and examples thereof include a conventional contact charging device, equipped with an electroconductive or semiconductive roller, brush, film, or rubber blade, and a non-contact charging device utilizing corona discharge, such as corotron, and scorotron.

As for a shape of the charging unit, for example, any of a roller, a magnetic brush, or a fur brush can be used. The shape thereof can be selected depending on the specification and embodiment of the electrophotographic image forming apparatus. In the case where the magnetic brush is used, for example, the magnetic brush is composed of various ferrite particles (e.g., Zn—Cu ferrite) serving as a charging unit, a non-magnetic electroconductive sleeve configured to support the ferrite particles, and a magnet roll covered with the electroconductive sleeve. In the case where the brush is used, for example, a fur that is subjected to an electroconductive treatment with carbon, copper sulfide, metal, or metal oxide, is used as a material of the fur brush. A charger is formed by winding the aforementioned fur material around a core, which is a metal or another electroconductive-treated core, or bonding the fur material thereon.

The charger is not limited to the aforementioned contact-type charger, but use of the contact charger has an advantage that an image forming apparatus, in which an amount of ozone generated by the charger is reduced, can be attained.

It is preferred that the charger be provided in contact with the image bearer, or not in contact with the image bearer, and a surface of the latent image bearer be charged by applying superimposed AC voltage and DC voltage using the charger.

Moreover, another preferable embodiment is that a gap tape is provided to the latent image bearer, and the charger is a charging roller provided adjacent to the latent image bearer, in a non-contact manner, and configured to charge a surface of the latent image bearer by applying superimposed AC voltage and DC voltage to the charging roller.

<Exposing Step and Exposing Unit>

The exposing step is a step containing exposing the surface charged of the electrostatic latent image bearer to light, and is performed by the exposing unit.

The exposure can be performed by exposing the surface of the electrostatic latent image bearer to light imagewise using the exposing unit.

An optical system used in the exposure is roughly classified into an analog optical system, and a digital optical system. The analog optical system is an optical system, which directly projects a document on the electrostatic latent image bearer, and the digital optical system is an optical system, which receives image information as electric signals, and turns the electric signals into optical signals to expose the electrophotographic photoconductor to light to form an image.

The exposing unit is appropriately selected depending on the intended purpose without any limitation, provided that it is capable of exposing the surface of the electrostatic latent image bearer, which has been charged by the charging unit, to light imagewise to be formed. Examples thereof include various exposure devices, such as a copy optical system, a rod lens array system, a laser optical system, a crystal shutter optical system, and a LED optical system.

Note that, in the present invention, a back side system may be employed, where the back side system means that imagewise exposure is performed from the back side of the electrostatic latent image bearer.

<Developing Step and Developing Unit>

The developing step is a step of developing the electrostatic latent image with a toner or to form a visible image.

The visible image may be formed, for example, by developing the electrostatic latent image with the toner, and the development may be carried out by the developing unit.

The developing unit is not particularly limited as long as, for example, the development can be carried out with the toner. The developing unit may be properly selected from conventional ones. A suitable example of the developing unit contains at least, for example, a developing device that contains the toner and can apply the toner to the electrostatic latent image in a contact or non-contact manner.

The developing device may be of a dry development type or a wet development type, or a single-color developing device or a multi-color developing device. For example, a developing device containing an agitator, which performs friction agitation of the toner for charging, and a rotatable magnet roller is suitable.

For example, the toner and the carrier (if necessary) are mixed and agitated within the developing device. At that time, the toner is electrified by friction and is held in a napping state on the surface of the magnet roller being rotated to form a magnetic brush. Since the magnet roller is disposed near the electrostatic latent image bearer, a part of the toner constituting the magnetic brush formed on the surface of the magnet roller is travelled to the surface of the electrostatic latent image bearer by electrical attraction. As a result, the electrostatic latent image is developed with the toner to form a visible image of the toner on the surface of the electrostatic latent image bearer.

The toner stored in the developing device may be a developer containing the toner. The developer may be a one-component developer or a two-component developer.

<Transfer Step and Transfer Unit>

The transfer step is a step of transferring the visible image onto a recording medium. Preferably, the visible image is primarily transferred onto the intermediate transfer member and then the visible image is secondarily transferred onto the recording medium. More preferably, two or more color toners, preferably full-color toners are used, the transfer step includes a primary transfer step of transferring the visible image onto the intermediate transfer member to form a composite transfer image thereon, and a secondary transfer step of transferring the composite transfer image onto a recording medium.

The transferring can be performed, for example, by charging the visible image formed on the electrostatic latent image bearer using a transfer unit, and can be performed by the transfer unit. The transfer step preferably includes a primary transfer step of transferring the visible image onto the intermediate transfer member to form a composite transfer image thereon, and a secondary transfer step of transferring the composite transfer image onto a recording medium.

The intermediate transfer member is not particularly limited and may be appropriately selected from those known in the art depending on the intended purpose. Example thereof includes a transfer belt.

The transfer unit (the primary transfer unit and the secondary transfer unit) preferably contains at least a transfer device that separates and electrifies the visible image formed on the electrostatic latent image bearer for transfer to the recording medium side. The number of transfer units used may be either one or two or more. Examples of transfer devices include corona transfer devices by corona discharge, transfer belts, transfer rollers, pressure transfer rollers, and pressure-sensitive transfer devices.

Note that, the recording medium is typically plain paper, but is not particularly limited and may be appropriately selected depending on the intended purpose, so long as it can receive a non-fixed image after developing. A PET base for OHP can be also used as the recording medium.

<Fixing Step and Fixing Unit>

The fixing step is a step including fixing the transferred toner image onto a recording medium, and the fixing can be performed by the fixing unit. In the case where two or more color toners are used, fixing may be performed every time when a toner of each color is transferred to a recording medium, or fixing is performed in a state where toners of all colors are transferred and laminated on a recording medium. The fixing unit is not particularly limited, and can employ a heat fixing system using a conventional heat pressure member. Examples of the heat pressure member include a combination of a heating roller and a pressure roller, and a combination of a heating roller, a pressure roller, and an endless belt. During fixing, the heating temperature is appropriately selected depending on the intended purpose without any limitation, but the temperature is preferably 80° C. to 200° C. Optionally, for example, a conventional light fixing device may be used in combination with the fixing unit.

<Cleaning Step and Cleaning Unit>

The cleaning step is a step containing removing the toner remained on the electrostatic latent image bearer, and can be suitably performed by the cleaning unit.

The cleaning unit is appropriately selected from conventional cleaners without any limitation, provided that it can remove the toner remained on the electrostatic latent image bearer. Examples thereof include a magnetic brush cleaner, a static brush cleaner, a magnetic roller cleaner, a cleaning blade, a brush cleaner, and a web cleaner. Among them, a cleaning blade is particularly preferable, as the cleaning blade has a high performance for removing the toner, and is small in the size and inexpensive.

Examples of a material of a rubber blade used for the cleaning blade include urethane rubber, silicone rubber, a fluorine rubber, chloroprene rubber, and butadiene rubber. Among them, urethane rubber is particularly preferable.

<Other Steps and Other Units>

Examples of the aforementioned other units include a charge-eliminating unit, a recycle unit, and a controlling unit.

Examples of the aforementioned other steps include a charge-eliminating step, a recycle step, and a controlling step.

—Discharging Step and Discharging Unit—

The discharging step is a step of applying a discharging bias to the electrostatic latent image bearer to perform discharging and can be suitably carried out by a discharging unit.

The discharging unit is not particularly limited as far as it can apply a discharging bias to the image bearer and may be properly selected from conventional discharging devices. Examples of suitable discharging devices include discharging lamps.

—Recycling Step and Recycling Unit—

The recycling step is a step of recycling the toner removed by the cleaning step to the developing unit and can be suitably carried out by a recycling unit.

The recycling unit is not particularly limited and may be a conventional conveying unit.

—Control Step and Control Unit—

The control step is a step of controlling each of the steps and can be suitably carried out by a control unit.

The control unit is not particularly limited as long as the movement of each of the units can be controlled. The control unit may be appropriately selected depending on the intended purpose, and examples thereof include equipment such as sequencers and computers.

Here, one example of a color-image forming apparatus of the present invention will be described with reference to drawings.

The tandem image forming apparatus is an apparatus obtained by arranging a plurality of image forming elements, each including an electrostatic latent image bearer, a charging unit, a developing unit, and a transfer unit. This tandem image forming apparatus is equipped with four image forming elements (for yellow, magenta, cyan, and black). Visible images are each formed in parallel by the four image forming elements, and the resultant formed visible images are put on top of one another on a recording medium or an intermediate transfer member. Therefore, a full-color image can be formed at high speed.

Figure 2:
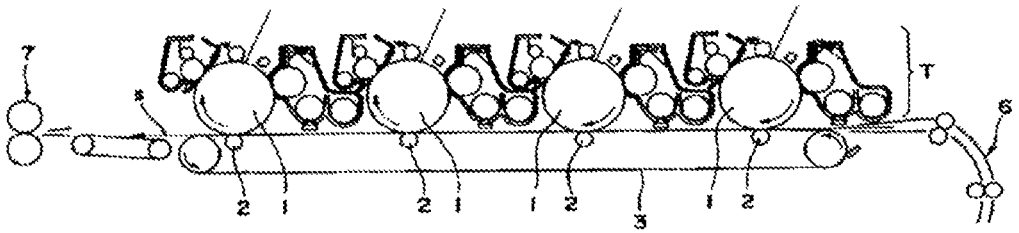
FIG. 2 is a schematic configuration view illustrating one example of a tandem image forming apparatus.
Figure 3:
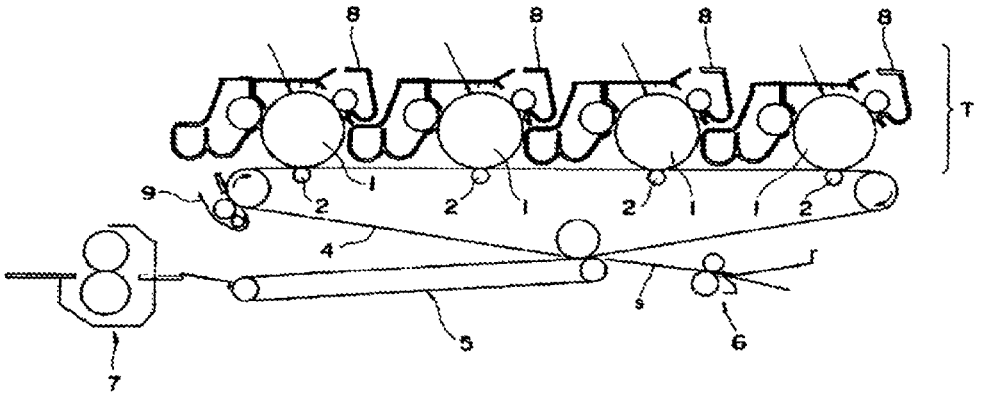
FIG. 3 is a schematic configuration view illustrating another example of a tandem image forming apparatus.

As the tandem image forming apparatus, there are two transfer systems: (1) a direct transfer system as illustrated in FIG. 2, where a recording medium S is transferred so as to pass through a transfer position opposite to each of the electrostatic latent image bearers 1 in a plurality of image forming apparatus, followed by transferring a visible image formed on each of the electrostatic latent image bearers 1 by a transfer unit 2; and (2) an indirect transfer system as illustrated in FIG. 3, where a visible image formed on each of the electrostatic latent image bearers 1 in the plurality of image forming apparatus is subsequently transferred onto an intermediate transfer member 4 by a transfer unit (primary transfer unit) 2, and then the images on the intermediate transfer member 4 are collectively transferred onto the recording medium S by a secondary transfer unit 5. Note that, a transfer conveyance belt is used as the secondary transfer unit in FIG. 3, the secondary transfer unit may be in a shape of a roller.

Comparing the (1) direct transfer system to the (2) indirect transfer system, an installation size of the (1) direct transfer system becomes large in the recording medium transporting direction, because a paper feeding device 6 needs to be provided at the upstream side of the tandem type image forming unit T, in which electrostatic latent image bearers 1 are aligned, and a fixing device 7 serving as the fixing unit needs to be provided at the downstream side of the tandem type image forming unit T. On the other hand, a secondary transfer position can be relatively freely designed in the (2) indirect transfer system, the paper feeding device 6 and the fixing device 7 can be arranged to vertically overlapped with the tandem type image forming unit T, so that a size of the system can be reduced.

In the (1) direct transfer system, moreover, the fixing device 7 is provided close to the tandem type image forming unit T in order to prevent the size thereof large along the recording medium transporting direction. Therefore, the fixing device 7 cannot be provided with a sufficient space so that the recording medium S can be bent, and hence the fixing device 7 tends to affect the image formation of the upstream side by the impact caused when the edge of the recording medium S enters into the fixing device 7 (which becomes significant specially with a thick recording medium), or a difference in the speed between the conveying speed of the recording medium passing through the fixing device 7, and the transporting speed of the recording medium by the transfer conveyance belt. On the other hand, the fixing device 7 hardly affects image formation in the (2) indirect transfer system, as the fixing device 7 can be provided with a sufficient space so that the recording medium S can be bent.

From the reasons as mentioned above, an intermediate transfer system has been currently particularly noted. As illustrated in FIG. 3, in such the color-image forming apparatus, the toner residues remained on the electrostatic latent image bearer 1 after the transferring is removed by the cleaning device 8 serving as the cleaning unit after the primary transferring to clean the surface of the electrostatic latent image bearer 1, so that the electrostatic latent image bearer 1 is ready for the next image formation process. Moreover, the toner residues remained on the intermediate transfer member 4 after the transferring is removed by the intermediate transfer member cleaning device 9 after the secondary transferring to clean the surface of the intermediate transfer member 4, to thereby make the intermediate transfer member 4 ready for the next image formation process.

Figure 4:
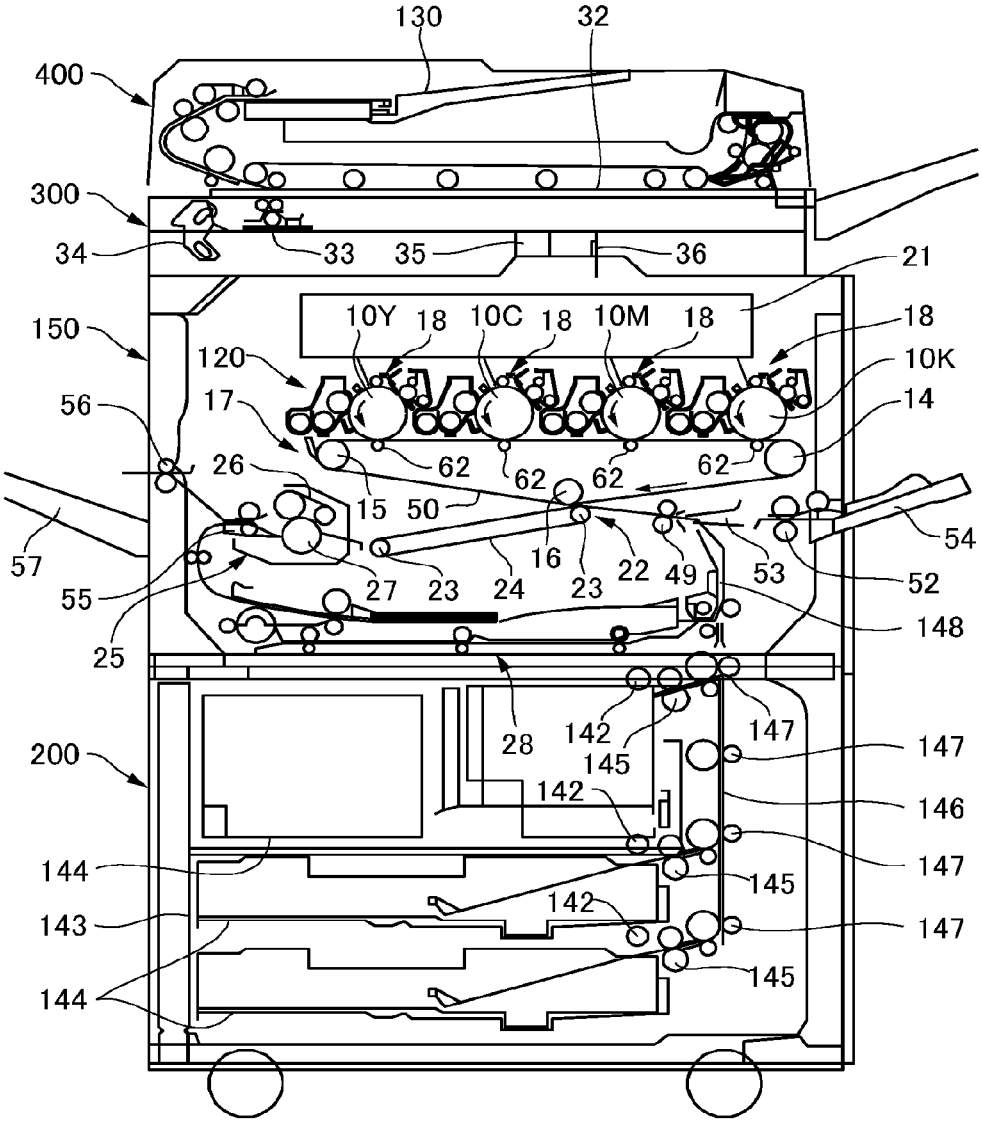
FIG. 4 is a schematic configuration view illustrating one example of a tandem image forming apparatus having an indirect transfer system.

Here, a tandem image forming apparatus illustrated in FIG. 4 is a tandem type color-image forming apparatus. This tandem type color-image forming apparatus includes a copying device main body 150, a paper feeding table 200, a scanner 300, and an automatic document feeder (ADF) 400.

An intermediate transfer member 50, which is an endless belt type, is disposed at a central part of the copying device main body 150. The intermediate transfer member 50 is stretched around support rollers 14, 15, and 16, and can rotate in a clockwise direction in FIG. 4. Near the support roller 15, an intermediate transfer member cleaning unit 17 is disposed in order to remove a residual toner remaining on the intermediate transfer member 50. On the intermediate transfer member 50 stretched around the support roller 14 and the support roller 15, a tandem type developing unit 120 is disposed, where the tandem type developing unit 120 includes four image forming units 18 (yellow, cyan, magenta, and black), arranged in parallel so as to face the intermediate transfer member 50 along a conveying direction. Near the tandem type developing unit 120, an exposing device 21 is disposed. A secondary transfer unit 22 is disposed on a side of the intermediate transfer member 50 opposite to a side where the tandem type developing unit 120 is disposed. In the secondary transfer unit 22, a secondary transfer belt 24, which is an endless belt, is stretched around a pair of rollers 23. The recording medium conveyed on the secondary transfer belt 24 and the intermediate transfer member 50 can contact each other. Near the secondary transfer unit 22, a fixing device 25 is disposed.

Here, an inverting device 28 configured to invert the transfer medium is disposed near the secondary transfer unit 22 and the fixing device 25, in order to form an image on both sides of the transfer medium.

Next, a method for forming a full-color image (color-copying) using the tandem type developing unit 120 will be described hereinafter. First, a color document is set on a document table 130 of the automatic document feeder (ADF) 400. Alternatively, the automatic document feeder 400 is opened, the color document is set on a contact glass 32 of the scanner 300, and the automatic document feeder 400 is closed.

When a start button (not illustrated) is pressed, the scanner 300 activates after the color document is conveyed and moved to the contact glass 32 in the case the color document has been set on the automatic document feeder 400, or right away in the case the color document has been set on the contact glass 32, so that a first travelling body 33 and a second travelling body 34 travel. At this time, light is irradiated from a light source in the first travelling body 33, the light reflected from a surface of the document is reflected by a mirror in the second travelling body 34 and then is received by a reading sensor 36 through an imaging forming lens 35. Thus, the color document (color image) is read to thereby form black, yellow, magenta and cyan image information.

Figure 5:
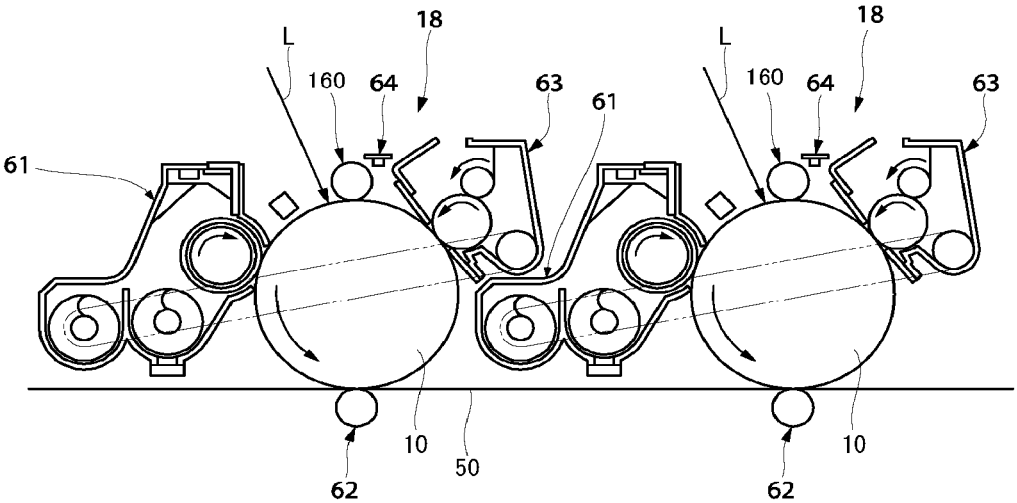
FIG. 5 is a schematic configuration view illustrating details of a tandem image forming apparatus.

Each image information of black, yellow, magenta, and cyan is transmitted to each of the image forming units 18 (black image forming unit, yellow image forming unit, magenta image forming unit, and cyan image forming unit) in the tandem type developing unit 120, and the toner images of black, yellow, magenta, and cyan are each formed in the image forming units. As illustrated in FIG. 4, the image forming units 18 (black image forming unit, yellow image forming unit, magenta image forming unit, and cyan image forming unit) in the tandem type developing unit 120 include: electrostatic latent image bearers 10 (black electrostatic latent image bearer 10K, yellow electrostatic latent image bearer 10Y, magenta electrostatic latent image bearer 10M, and cyan electrostatic latent image bearer 10C); a charging device 160 configured to uniformly charge the electrostatic latent image bearers 10; an exposing device configured to imagewise expose the electrostatic latent image bearers to light (L illustrated in FIG. 5) based on image information for each color, to form an electrostatic latent image corresponding to color images on the electrostatic latent image bearers; a developing device 61 configured to develop the electrostatic latent images with color toners (black toner, yellow toner, magenta toner, and cyan toner) to form a toner image of each of the color toners; a transfer charger 62 configured to transfer the toner image onto the intermediate transfer member 50; a cleaning device 63; and a charge-eliminating unit 64. Each image forming unit 18 can form a monochrome image (black image, yellow image, magenta image, and cyan image) based on image information of each color. Thus formed black image (i.e., black image formed onto the black electrostatic latent image bearer 10K), yellow image (i.e., yellow image formed onto the yellow electrostatic latent image bearer 10Y), magenta image (i.e., magenta image formed onto the magenta electrostatic latent image bearer 10M), and cyan image (i.e., cyan image formed onto the cyan electrostatic latent image bearer 10C) are sequentially transferred (primarily transferred) onto the intermediate transfer member 50 which is rotatably moved by the support rollers 14, 15 and 16. The black image, the yellow image, the magenta image, and the cyan image are superposed on top of one another on the intermediate transfer member 50 to thereby form a composite color image (color transfer image).

Meanwhile, on the paper feeding table 200, one of paper feeding rollers 142 selectively rotates to feed recording medium from one of the paper feeding cassettes 144 equipped in multiple stages in a paper bank 143. The sheet is separated one by one by a separation roller 145 and sent to a paper feeding path 146. The sheet (recording medium) is conveyed by a conveying roller 147 and is guided to a paper feeding path 148 in the copying device main body 150, and stops by colliding with a registration roller 49. Alternatively, a paper feeding roller 142 rotates to feed a sheet (recording medium) on a manual feed tray 54. The sheet (recording medium) is separated one by one by a separation roller 145 and is guided to a manual paper feeding path 53, and stops by colliding with the registration roller 49. Note that, the registration roller 49 is generally used so as to be grounded, but it may be also used in a state that a bias is applied for removing paper dust on the recording medium. Next, the registration roller 49 rotates in accordance with the timing of the composite toner image (color transferred image) formed on the intermediate transfer member 50, and the recording medium is fed to between the intermediate transfer member 50 and the secondary transfer unit 22. Thereby, the composite toner image (color transferred image) is transferred (secondarily transferred) by the secondary transfer unit 22 onto the recording medium to thereby form a color image on the recording medium. Notably, a residual toner remaining on the intermediate transfer member 50 after transferring image is removed by an intermediate transfer member cleaning 17.

The recording medium on which the color image has been transferred is conveyed by the secondary transfer unit 22, and then conveyed to the fixing device 25. In the fixing device 25, the composite color image (color transferred image) is fixed on the recording medium by applying heat and pressure. Next, the recording medium is switched by a switching claw 55, and discharged by a discharge roller 56 and stacked in a paper ejection tray 57. Alternatively, the recording medium is switched by the switching claw 55, and is inverted by the inverting device 28 to thereby be guided to a transfer position again. After an image is formed similarly on the rear surface, the recording paper is discharged by the discharge roller 56 stacked in the paper ejection tray 57.

EXAMPLES

The present invention will be described with reference to the following Examples. However, it should be noted that the present invention is not limited to these Examples. Here, "part(s)" means "part(s) by mass".

<Measurement of Hydrocarbon Compound by Ion Attachment Mass Spectrometry (IAMS)>

Hydrocarbon compounds in samples (toner, release agent) were evaluated using the following IAMS device.

(1) Device: IAMS (product of ANELVA)

(2) Measurement method: Measured under the following heating conditions: 30° C.→(128° C./min)→130° C.→(32° C./min)→300° C.

(3) Amount of sample: 5 mg of toner (4) Outline

The IAMS is an abbreviation of ion attachment mass spectrometry, and is a new method for measuring mass without destroying molecules.

In the IAMS, a lithium ion ($Li^+$) is attached to a neutral molecule (M) that is a sample gas, to form a $MLi^+$ ion (adduct ion).

A step of attaching M with $Li^+$($M\text{-}Li^+$) is a moderate step, and destroying molecules (formation into fragment) does not occurs.

The adduct ion can be subjected to mass spectrometry, and the obtained mass of the adduct ion is deducted from mass of $Li^+$ ion (7 amu), to determine a molecular weight of the original sample gas.

As there is no fragment ion, the evaluation can be performed in real time without isolating the mixed sample.

(5) Analysis of Results

Using the obtained mass component, a ratio of the total number of the hydrocarbon compound having 33 to 35 carbon atoms to another hydrocarbon compound was evaluated in terms of a signal intensity ratio. Note that, in the present invention, it is characteristic in that an evaluation value obtained by the IAMS is used as the number of the carbon. The conventional GCMS (gas chromatography-mass spectrometry) cannot be used because the number of carbon atoms in the sample cannot be evaluated with high precision.

<Measurement of Amount of Toner Reduced During Heating>

An amount of the toner reduced (heated at 165° C. for 10 minutes, and heated to 250° C. after heated at 165° C. for 10 min) was evaluated using a high sensitivity TGA device described below, under the following conditions.

(1) Device: TGA device model Q5000IR type (product of TA Instruments)

(2) Measurement method: Measured by the following heating conditions.

Room temperature→[10° C./minute]→165° C.→[maintaining for 10 minutes]→[10° C./minute]→250° C.

(3) Weight of sample: 0.35 mg (4) Measurement atmosphere: Nitrogen 35 cc/minute (5) Evaluation: An amount of the sample reduced when the sample is heated for 165° C. for 10 minutes, and an amount of the sample reduced when the sample is heated to 250° C. after heated for 165° C. for 10 minutes can be evaluated.

<Quantitative Evaluation of Ethyl Acetate>

The qualitative evaluation and the quantitative evaluation of ethyl acetate were performed by a cryotrap-GCMS method.

(1) Device: QP2010 (product of SHIMADZU CORPORATION), data analyzing software: GCMS solution (product of SHIMADZU CORPORATION), heating device: Py2020D (product of Frontier Laboratories Ltd.)

(2) Amount of sample: 10 mg (3) Conditions of thermal extraction: heating temperature: 180° C., heating time: 15 minutes (4) Cryotrap: −190° C.

(5) Column: Ultra ALLOY-5, L=30 m, ID=0.25 mm, Film=0.25 μm (6) Heating column: 60° C. (retained for 1 minute)→(10° C./min)→130° C.→(20° C./min)→300° C. (retained for 9.5 minutes)

(7) Pressure of carrier gas: 56.7 kPa, constantly (8) Column flow rate: 1.0 mL/min (9) Ionization method: EI method (70 eV)

(10) Mass range: m/z=29 to 700

<Confirmation of Toner Core-Shell Structure>

Confirmation of the core-shell structure of the toner was evaluated based on a method using the following TEM (transmission electron microscope).

The core-shell structure is defined as a state that the toner surface is covered with a contrast component that is different from the interior of the toner (shell layer). A thickness of the shell layer is preferably 50 nm or more.

First, about one spatula of the toner was embedded and hardened in an epoxy resin. The sample was exposed to a gas using ruthenium tetroxide, osmium tetroxide, or any other stain for 1 minute to 24 hours, to thereby stain the shell layer and the core interior distinguishably. The exposition time was appropriately adjusted according to the contrast observed. A cross-section of the toner was obtained with a knife, and an ultra-thin section (with a thickness of 200 nm) of the toner was produced with an ultramicrotome (ULTRA-CUT UCT, product of Leica Co., Ltd., using diamond knife). After this, the ultra-thin section was observed with a TEM (transmission electron microscope, H7000, product of Hitachi High-Technologies Corporation) at an accelerating voltage of 100 kV. The shell layer and the core might be distinguishable without stains depending on the composition thereof, and then were evaluated without stains. The compositional contrast can be also imparted by other means such as a selective etching. It is also preferable that TEM observation and evaluation of shell layer are performed after the aforementioned pretreatment.

Preparation Example 1 of Release Agent

Preparation of Release Agent 1

Paraffin wax (HNP-51, melting point: 77° C., product of NIPPON SEIRO CO., LTD.) was purified by the thin-film distillation method. The total amount of the hydrocarbon compounds having 33 to 35 carbon atoms therein evaluated by ion attachment mass spectrometry (IAMS) was adjusted so as to be 53% in terms of the signal intensity ratio, to thereby obtain release agent 1.

Preparation Example 2 of Release Agent

Preparation of Release Agent 2

Paraffin wax (HNP-51, melting point: 77° C., product of NIPPON SEIRO CO., LTD.) was purified by the thin-film distillation method. The total amount of the hydrocarbon compounds having 33 to 35 carbon atoms therein evaluated by ion attachment mass spectrometry (JAMS) was adjusted so as to be 40% in terms of the signal intensity ratio, to thereby obtain release agent 2.

Preparation Example 3 of Release Agent

Preparation of Release Agent 3

Paraffin wax (HNP-51, melting point: 77° C., product of NIPPON SEIRO CO., LTD.) was purified by the thin-film distillation method. The total amount of the hydrocarbon compounds having 33 to 35 carbon atoms therein evaluated by ion attachment mass spectrometry (JAMS) was adjusted so as to be 68% in terms of the signal intensity ratio, to thereby obtain release agent 3.

Preparation Example 4 of Release Agent

Preparation of Release Agent 4

Paraffin wax (HNP-51, melting point: 77° C., product of NIPPON SEIRO CO., LTD.) was purified by the thin-film distillation method. The total amount of the hydrocarbon compounds having 33 to 35 carbon atoms therein evaluated by ion attachment mass spectrometry (JAMS) was adjusted so as to be 36% in terms of the signal intensity ratio, to thereby obtain release agent 4.

Preparation Example 5 of Release Agent

Preparation of Release Agent 5

Paraffin wax (HNP-51, melting point: 77° C., product of NIPPON SEIRO CO., LTD.) was purified by the thin-film distillation method. The total amount of the hydrocarbon compounds having 33 to 35 carbon atoms therein evaluated by ion attachment mass spectrometry (IAMS) was adjusted so as to be 76% in terms of the signal intensity ratio, to thereby obtain release agent 5.

Example 1

Synthesis of Fine Resin Particle Emulsion

A reaction vessel equipped with a stirring bar and a thermometer was charged with water (683 parts), sodium salt of methacrylic acid-ethylene oxide adduct sulfate ester (ELEMINOL RS-30, product of Sanyo Chemical Industries, Ltd.) (11 parts), polylactic acid (10 parts), styrene (50 parts), methacrylic acid (100 parts), butyl acrylate (80 parts), and ammonium persulfate (1 part), and the resultant mixture was stirred at 3,800 rpm for 30 minutes, which resulted in a white emulsion. The emulsion was heated until the temperature in the system reached 75° C., and was allowed to react for 4 hours. A 1% ammonium persulfate aqueous solution (30 parts) was further added thereto, and the resultant mixture was aged at 75° C. for 6 hour, to thereby obtain [fine particle dispersion liquid 1] that is an aqueous dispersion liquid of vinyl resin (copolymer of styrene/methacrylic acid/butyl acrylate/sodium salt of methacrylic acid-ethylene oxide adduct sulfate ester).

The obtained [fine particle dispersion liquid 1] was measured by a particle diameter measuring apparatus (LA-920, product of HORIBA, Ltd.), and was found to have a volume average particle diameter of 210 nm. A part of the obtained [fine particle dispersion liquid 1] was dried to thereby isolate a resin component. The resin component was found to have a glass transition point (Tg) of 59° C. and a weight average molecular weight of 38,000.

<Preparation of Aqueous Phase 1>

Water (990 parts), 83 parts of the [fine particle dispersion liquid 1], 37 parts of a 48.3% by mass aqueous solution of sodium dodecyldiphenyl ether disulfonate (ELEMINOL MON-7, product of Sanyo Chemical Industries Ltd.), and 90 parts of ethyl acetate were mixed and stirred, to thereby obtain an opaque white liquid. The obtained liquid was used as [aqueous phase 1].

<Synthesis of Non-Crystalline Low Molecular Polyester 1>

A reaction vessel equipped with a condenser, a stirring device, and a nitrogen-introducing tube was charged with 450 parts of bisphenol A propylene oxide 2 mole adduct, 280 parts of bisphenol A propylene oxide 3 mole adduct, 247 parts of terephthalic acid, 75 parts of isophthalic acid, 10 parts of maleic anhydride, and 2 parts of titanium dihydroxy bis(triethanol aminate) as a condensation catalyst. Then, the resultant mixture was allowed to react at 220° C. for 10 hours while water generated in a nitrogen stream was removed.

Next, the mixture was allowed to react under a reduced pressure of 5 mmHg to 20 mmHg. When the acid value thereof reached 8 mg KOH/g, the mixture was taken out, cooled to room temperature, and pulverized, to thereby obtain [non-crystalline low molecular polyester 1].

The obtained [non-crystalline low molecular polyester 1] was found to have a number average molecular weight of 5,500, a weight average molecular weight of 27,600, a glass transition point (Tg) of 60° C., and an acid value of 9 mg KOH/g.

<Synthesis of Non-Crystalline Intermediate Polyester 1>

A reaction vessel equipped with a condenser, a stirring device, and a nitrogen-introducing tube was charged with 660 parts of bisphenol A ethylene oxide 2 mole adduct, 103 parts of bisphenol A propylene oxide 2 mole adduct, 283 parts of terephthalic acid, 22 parts of trimellitic anhydride, and 2 parts of dibutyltin oxide. Thereafter, the resultant mixture was allowed to react for 7 hours at 230° C. under normal pressure, and was further allowed to react for 5 hours under a reduced pressure of 10 mmHg to 15 mmHg, to thereby obtain [intermediate polyester 1].

The obtained [intermediate polyester 1] was found to have a number average molecular weight of 3,200, a weight average molecular weight of 13,000, a glass transition point (Tg) of 55° C., an acid value of 0.5 mg KOH/g, and a hydroxyl value of 52 mg KOH/g.

<Synthesis of Prepolymer 1>

Next, a reaction vessel equipped with a condenser, a stirring device, and a nitrogen-introducing tube was charged with 410 parts of the [intermediate polyester 1], 89 parts of isophorone diisocyanate, and 500 parts of ethyl acetate, and the resultant mixture was allowed to react at 100° C. for 5 hours, to thereby obtain [prepolymer 1]. The obtained [prepolymer 1] was found to have a mass of free isocyanate of 1.53%.

<Synthesis of Ketimine Compound 1>

A reaction vessel equipped with a stirring bar and a thermometer was charged with 170 parts of isophoronediamine and 75 parts of methyl ethyl ketone, and the resultant mixture was allowed to react at 50° C. for 4.5 hours, to thereby obtain [ketimine compound 1]. The obtained [ketimine compound 1] was found to have an amine value of 417.

<Preparation of Master Batch 1>

The [non-crystalline low molecular polyester 1] (100 parts), 100 parts of a cyan pigment (C.I. Pigment blue 15:3), and 100 parts of ion-exchanged water were mixed with HENSCHEL MIXER (product of NIPPON COKE & ENGINEERING CO., LTD.), and the resultant mixture was kneaded by an open roll type kneader (KNEADEX, product of NIPPON COKE & ENGINEERING CO., LTD.). After kneading at 90° C. for 1 hour, the kneaded product was rolled out and cooled, followed by pulverizing by a pulverizer, to thereby obtain [master batch 1].

<Synthesis of Crystalline Polyester Resin 1>

A reaction vessel equipped with a condenser, a stirring device, and a nitrogen-introducing tube was charged with 1,200 parts of 1,6-hexanediol, 1,200 parts of decanedioic acid, and 0.4 parts of dibutyltin oxide as a catalyst. Then, air in the vessel was purged with nitrogen gas by vacuum operation to be an inert atmosphere, followed by stirring for 5 hours at 180 rpm using a stirring device. Thereafter, the resultant mixture was gradually heated to 210° C. under a reduced pressure, and was stirred for 1.5 hours. When the resultant mixture became a viscous product, it was air-cooled, and the reaction was stopped, to thereby obtain [crystalline polyester resin 1].

The obtained [crystalline polyester resin 1] was found to have a number average molecular weight of 3,400, a weight average molecular weight of 15,000, and a melting point of 64° C.

<Preparation of Oil Phase 1>

A vessel to which a stirring bar and a thermometer had been set was charged with 530 parts of the [non-crystalline low molecular polyester 1], 110 parts of the [release agent 1], 90 parts of the [crystalline polyester resin 1], and 947 parts of ethyl acetate, followed by heating to 80° C. during stirring. The mixture was maintained at 80° C. for 5 hours, and was cooled to 30° C. for 20 hours during slowly grown to be a crystal. Then, the vessel was charged with 100 parts of the [master batch 1] and 100 parts of ethyl acetate, and the resultant mixture was mixed for 1 hour, to thereby obtain [materials dissolving solution 1].

The [materials dissolving solution 1] (1,324 parts) was transferred to a vessel, and a colorant and a wax were dispersed therein by a bead mill (ULTRA VISCOMILL, product of AIMEX CO., Ltd.) under the following conditions: a liquid feed rate of 1 kg/hr, disc circumferential velocity of 6 m/s, zirconia beads having a diameter of 0.5 mm packed to 80% by volume, and 3 passes.

Next, 1,324 parts of 65% by mass ethyl acetate solution of the [non-crystalline low molecular polyester 1] was subjected to 6 passes using the bead mill described in the above conditions, to thereby obtain [colorant•wax dispersion liquid 1]. The obtained [colorant•wax dispersion liquid 1] was found to have a solid content concentration (130° C., 30 minutes) of 50% by mass.

<Emulsification and Removal of Solvent>

A vessel was charged with 749 parts of the [colorant•wax dispersion liquid 1], 120 parts of the [prepolymer 1], and 3.5 parts of the [ketimine compound 1], and the resultant mixture was mixed by a TK homomixer (product of PRIMIX Corporation) at 5,000 rpm for 5 minutes. Then, 1,200 parts of the [aqueous phase 1] was added to the vessel, and the mixture was mixed by a TK homomixer at 10,000 rpm for 3 hours, to thereby obtain [emulsified slurry 1].

A container equipped with a stirrer and a thermometer was charged with the [emulsified slurry 1], and the solvent was removed at 30° C. for 24 hours, followed by ageing at 40° C. for 24 hours. Thereafter, the resultant mixture was heated at 45° C. for 36 hours in order to grow a crystal, to thereby obtain [dispersion slurry 1].

<Washing and Drying>

After subjecting 100 parts of the [dispersion slurry 1] to filtration under a reduced pressure, the obtained cake was subjected twice to a series of treatments (1) to (4) described below, to thereby produce [filtration cake 1].

(1) ion-exchanged water (100 parts) was added to the filtration cake, followed by mixing with a TK Homomixer (at 12,000 rpm for 10 minutes), and then the mixture was filtrated;

(2) one hundred parts of 10% by mass aqueous sodium hydroxide solution was added to the filtration cake obtained in (1), followed by mixing with a TK Homomixer (at 12,000 rpm for 30 minutes), and then the resultant mixture was filtrated under a reduced pressure;

(3) one hundred parts of 10% by mass hydrochloric acid was added to the filtration cake obtained in (2), followed by mixing with a TK Homomixer (at 12,000 rpm for 10 minutes) and then the mixture was filtrated; and (4) ion-exchanged water (300 parts) was added to the filtration cake obtained in (3), followed by mixing with a TK Homomixer (at 12,000 rpm for 10 minutes) and then the mixture was filtrated.

Next, the obtained [filtration cake 1] was dried with an air-circulating drier at 45° C. for 72 hours, and then was caused to pass through a sieve with a mesh size of 75 μm, to thereby obtain [toner base particle 1].

Then, 100 parts of the [toner base particle 1] and 1 part of the hydrophobic silica having an average particle diameter of 13 nm were mixed with HENSCHEL MIXER, to thereby obtain [toner 1].

Physical properties of the obtained [toner 1] were evaluated as follows. Results were given in Table 1-1 and Table 1-2.

<Average Circularity>

An average circularity of the toner was measured by a flow type particle image analyzer ("FPIA-2100", product of SYSMEX CORPORATION), and analysis was performed using an analysis software (FPIA-2100, Data Processing Program for FPIA version 00-10). Specifically, a 10% by mass surfactant (alkyl benzene sulfonate, NEOGEN SC-A, product of DKS Co. Ltd.) (0.5 mL) was added to a 100 mL-glass beaker, 0.5 g of the toner was added thereto, followed by stirring by a micro-spatula. Then, 80 mL of ion-exchanged water was added thereto. The obtained dispersion liquid was subjected to the dispersion treatment for 3 minutes by an ultrasonic wave disperser (product of HONDA ELECTRONICS CO., LTD.). A concentration of the dispersion liquid is adjusted to 15,000 particles/μL, and a shape and a distribution of the dispersion liquid were measured using the FPIA-2100.

<Weight Average Particle Diameter and Weight Average Particle Diameter/Number average Particle Diameter>

The weight average particle diameter ($D_4$), the number average particle diameter ($D_n$), and the ratio therebetween ($D_4/D_n$) of the toner were measured using Coulter Multisizer II. The measurement method will be described as follows.

First, 5 mL of a surfactant (polyoxyethylene alkyl ether (nonionic surfactant)) as a dispersing agent was added to 150 mL of an aqueous electrolyte solution. Here, the aqueous electrolyte solution is a 1% by mass aqueous NaCl solution prepared using 1st grade sodium chloride, and ISOTON-II (product of Coulter, Inc.) was used. Next, 20 mg of a measurement sample was added thereto. The resultant aqueous electrolyte solution obtained by suspending the sample was dispersed with an ultrasonic wave disperser for 3 min. The weight and the number of the toner particle or the toner were measured to determine the weight particle size distribution and the number particle size distribution. From these distributions, the weight average particle diameter ($D_4$) and the number average particle diameter ($D_n$) of the toner were obtained.

In this measurement, 13 channels are used: 2.00 μm (inclusive) to 2.52 μm (exclusive); 2.52 μm (inclusive) to 3.17 μm (exclusive); 3.17 μm (inclusive) to 4.00 μm (exclusive); 4.00 μm (inclusive) to 5.04 μm (exclusive); 5.04 μm (inclusive) to 6.35 μm (exclusive); 6.35 μm (inclusive) to 8.00 μm (exclusive); 8.00 μm (inclusive) to 10.08 μm (exclusive); 10.08 μm (inclusive) to 12.70 μm (exclusive); 12.70 μm (inclusive) to 16.00 μm (exclusive); 16.00 μm (inclusive) to 20.20 μm (exclusive); 20.20 μm (inclusive) to 25.40 μm (exclusive); 25.40 μm (inclusive) to 32.00 μm (exclusive); and 32.00 μm (inclusive) to 40.30 μm (exclusive); i.e., particles having a particle diameter of 2.00 μm (inclusive) to 40.30 μm (exclusive) were subjected to the measurement.

Next, a two-component developer was prepared using the prepared toner in the following manner.

<Production of Carrier>

| Core- | |
|---|---|
| Mn ferrite particles (weight average diameter: 35 μm) | 5,000 parts |
| Coating materials | |
| Toluene | 450 parts |
| Silicone resin (SR2400, product of by Dow Corning Toray Co., Ltd., a non-volatile content 50%) | 450 parts |
| Amino silane (SH6020, product of Dow Corning Toray Co., Ltd.) | 10 parts |
| Carbon black | 10 parts |

The coating materials were dispersed with a stirrer for 10 minutes to prepare a coating liquid. The coating liquid and the core were charged into a coating machine including a rotary bottom plate disk and a stirring blade in a fluid bed and configured to perform coating by forming a circulating current, to thereby coat the core with the coating liquid. The obtained coated material was burned in an electric furnace at 250° C. for 2 hours, to thereby obtain a carrier.

<Preparation of Two-Component Developer>

Using a carrier coated with a silicone resin so as to be an average thickness of 0.5 μm and having an average particle diameter of 35 μm, 7 parts of the toner was uniformly mixed with 100 parts of the carrier with a turbula mixer configured to stir materials with a tumbling motion of a container, and then was electrically charged, to thereby obtain a two-component developer.

Next, physical properties of the prepared toner and two-component developer were evaluated as follows using the following image forming apparatuses. Results are given in Table 3.

<Image Forming Apparatus>

As an image forming apparatus, the evaluation apparatus A and the evaluation apparatus B described below were provided.

<<Evaluation Apparatus A>>

A tandem image forming apparatus (imagio MP C6000, product of Ricoh Company, Ltd.) was modified mainly in the fixing portion, and was used as evaluation apparatus A. The apparatus was adjusted to have a print speed of 350 mm/sec. The fixing unit of the fixing portion was adjusted to have a contact pressure by the fixing member of 40 N/cm$^2$, and a fixing nip time of 40 ms. The surface of the fixing member was coated with tetrafluoroethylene/perfluoroalkylvinylether copolymer resin (PFA). Then, the obtained fixing member was shaped and adjusted on the surface thereof for use. Note that, a heating temperature of the fixing unit was set to 100° C.

<<Evaluation Apparatus B>

A tandem image forming apparatus (imagio MP C6000, product of Ricoh Company, Ltd.) was modified mainly in the fixing portion, and was used as evaluation apparatus B. All of the developing unit, the transfer unit, the cleaning unit, and the conveying unit were changed or adjusted so that a print speed of the apparatus was 2,200 mm/sec. The fixing unit of the fixing portion was adjusted to have a contact pressure by the fixing member of 110 N/cm$^2$, and a fixing nip time of 130 ms. The surface of the fixing member was coated with tetrafluoroethylene/perfluoroalkylvinylether copolymer resin (PFA). Then, the obtained fixing member was shaped and adjusted on the surface thereof for use.

Note that, a heating temperature of the fixing unit was set to 100° C.

<Print Speed>

Print speed was measured as follows. Output was continuously performed on an A4-size paper that is a longitudinal feeding paper, for 100 papers (length of the longitudinal feeding paper: 297 mm). When an output time from the start to the end is defined as A second, and a print speed is defined as B mm/sec, the print speed was determined based on the following formula.

$$B\ (\text{mm/sec})=100\ \text{papers}\times 297\ \text{mm}+A\ \text{second}$$

<Contact Pressure by Fixing Member>

The contact pressure by the fixing member is a contact pressure of a recording medium applied by a fixing member, and can be measured by a pressure distribution measuring device (PINCH, product of Nitta Corporation).

<Fixing Nip Time>

The linear velocity and a fixing nip width was measured to calculate the fixing nip time.

<Clogging of Exhaust Filter>

Using the obtained two-component developer and the evaluation apparatus A or B, a 10% image area chart was output on 60,000 papers under an environment of temperature of 25° C. and a humidity of 60% RH. Then, clogging of exhaust filter of the exhaust fan of the evaluation apparatuses was evaluated based on the following evaluation criteria.

[Evaluation Criteria]

A: Clogging of exhaust filter is at a low level, which is excellent.

B: Clogging of exhaust filter can be slightly observed, which does not influence exhausting property, and is at an acceptable level.

C: Clogging of exhaust filter occurs, which is problematic.

<Carrier Spent Property>

Using the obtained two-component developer and the evaluation apparatus A or B, a 10% image area chart was output on 60,000 papers under an environment of high temperature and high humidity (temperature: 45° C. and humidity: 80% RH). The toner in the two-component developer was removed through blowing with air, and then the surface of the carrier was observed by FE-SEM (product of Hitachi High-Technologies Corporation, ultra-high resolution scanning electron microscope SU8200, accelerating voltage: 1 kV). Carrier spent property (evaluation of foreign substance adhering to carrier) was evaluated based on the following evaluation criteria.

[Evaluation Criteria]

A: Carrier spent property is excellent.

B: Carrier spent is slightly observed, but does not largely cause reduction of electric charge amount, which are at an acceptable level.

C: Carrier spent is clearly observed, and an electric charge amount is also large, which are problematic.

<Low Temperature Fixing Ability after Evaluating Durability>

Using the obtained two-component developer and the evaluation apparatus A or B, a 10% image area chart was output on 60,000 papers under an environment of temperature of 25° C. and a humidity of 60% RH. Then, the fixing temperature was changed in steps of 5° C., and an image was output, to measure low temperature fixing ability as follows. As transfer paper, RICOH FULL COLOR PPC PAPER TYPE 6200 was used.

The fixing temperature of a fixing device was changed, and a print image was obtained so as to have an image density of 1.2 as measured by X-Rite 938 (product of X-Rite). Each of the copy images obtained at each temperatures was rubbed by a clock meter equipped with a sand eraser for 50 times, and an image density before and after rubbing the copy image, to determine a fixing rate based on the following formula.

Fixing ratio (%)=[(image density after rubbing image with sand eraser for 50 times)/(image density before rubbing image with sand eraser)]

Therefore, a temperature that the fixing ratio reaches 80% or more is defined to as minimum fixing temperature. The determined minimum fixing temperature was evaluated for low temperature fixing ability based on the following evaluation criteria.

[Evaluation Criteria]

A: Minimum fixing temperature is 105° C. to 110° C., which is low, and the toner is excellent in low temperature fixing ability.

B: Minimum fixing temperature is 115° C. to 130° C., which is equivalent to low temperature fixing ability of the conventional toners.

C: Minimum fixing temperature is 135° C. to 170° C., which is high, and the resultant toner is poor in low temperature fixing ability.

Example 2

[Toner 2] was obtained in the same manner as in Example 1 except that the [non-crystalline low molecular polyester 1] was changed to the [non-crystalline low molecular polyester 2] described below.

Physical properties of the obtained toner were given in Table 1, and evaluation criteria using the evaluation apparatus A were given in Table 3.

<Synthesis of Non-Crystalline Low Molecular Polyester 2>

A reaction vessel equipped with a condenser, a stirring device, and a nitrogen-introducing tube was charged with 450 parts of bisphenol A propylene oxide 3 mole adduct, 280 parts of bisphenol A propylene oxide 3 mole adduct, 247 parts of terephthalic acid, 75 parts of isophthalic acid, 10 parts of maleic anhydride, and 2 parts of titanium dihydroxy bis(triethanol aminate) as a condensation catalyst. Then, the resultant mixture was allowed to react at 260° C. for 12 hours while water generated in a nitrogen stream was removed. Next, the mixture was allowed to react under a reduced pressure of 5 mmHg to 20 mmHg. When the acid value thereof reached 8 mg KOH/g, the mixture was taken out, cooled to room temperature, and pulverized, to thereby obtain [non-crystalline low molecular polyester 2].

The obtained [non-crystalline low molecular polyester 2] was found to have a number average molecular weight of 5,600, a weight average molecular weight of 29,200, a glass transition point (Tg) of 60° C., and an acid value of 9 mg KOH/g.

Example 3

[Toner 3] was obtained in the same manner as in Example 1 except that the <Preparation of oil phase 1> was changed to the following.

Physical properties of the obtained toner were given in Table 1, and evaluation criteria using the evaluation apparatus A were given in Table 3.

<Preparation of Oil Phase 3>

A vessel to which a stirring bar and a thermometer had been set was charged with 530 parts of the [non-crystalline low molecular polyester 1], 110 parts of the [release agent 2], 90 parts of the [crystalline polyester resin 1], and 947 parts of ethyl acetate, followed by heating to 80° C. during stirring. The mixture was maintained at 80° C. for 5 hours, and was cooled to 30° C. for 20 hours during slowly grown to be a crystal. Then, the vessel was charged with 100 parts of the [master batch 1] and 100 parts of ethyl acetate, followed by mixing for 1 hour, to thereby obtain [materials dissolving solution 3].

Example 4

[Toner 4] was obtained in the same manner as in Example 1 except that the <Preparation of oil phase 1> was changed to the following.

Physical properties of the obtained toner were given in Table 1, and evaluation criteria using the evaluation apparatus A were given in Table 3.

<Preparation of Oil Phase 4>

A vessel to which a stirring bar and a thermometer had been set was charged with 530 parts of the [non-crystalline low molecular polyester 1], 110 parts of the [release agent 3], 90 parts of the [crystalline polyester resin 1], and 947 parts of ethyl acetate. The resultant mixture was heated to 80° C. during stirring. The mixture was maintained at 80° C. for 5 hours, and was cooled to 30° C. for 20 hours during slowly grown to be a crystal. Then, the vessel was charged with 100 parts of the [master batch 1] and 100 parts of ethyl acetate, and the resultant mixture was mixed for 1 hour, to thereby obtain [materials dissolving solution 4].

Example 5

[Toner 5] was obtained in the same manner as in Example 1 except that the [non-crystalline low molecular polyester 1] was changed to the [non-crystalline low molecular polyester 3] described below.

Physical properties of the obtained toner were given in Table 1, and evaluation criteria using the evaluation apparatus A were given in Table 3.

<Synthesis of Non-Crystalline Low Molecular Polyester 3>

A reaction vessel equipped with a condenser, a stirring device, and a nitrogen-introducing tube was charged with 450 parts of bisphenol A propylene oxide 2 mole adduct, 280 parts of bisphenol A propylene oxide 3 mole adduct, 247 parts of terephthalic acid, 75 parts of isophthalic acid, 10 parts of maleic anhydride, and 2 parts of titanium dihydroxy bis(triethanol aminate) as a condensation catalyst. Then the resultant mixture was allowed to react at 210° C. for 7 hours while water generated in a nitrogen stream was removed. Next, the mixture was allowed to react under a reduced pressure of 5 mmHg to 20 mmHg. When the acid value thereof reached 8 mg KOH/g, the mixture was taken out, cooled to room temperature, and pulverized, to thereby obtain [non-crystalline low molecular polyester 3].

The obtained [non-crystalline low molecular polyester 3] was found to have a number average molecular weight of 5,300, a weight average molecular weight of 26,100, a glass transition point (Tg) of 59° C., and an acid value of 9 mg KOH/g.

Example 6

Using the toner of Example 1, evaluations of Example 6 were performed in the same manner as in Example 1 except that the valuation apparatus B was used. Results are given in Table 3.

Example 7

[Toner 6] was obtained in the same manner as in Example 1 except that the fine resin particle emulsion used in Example 1 was changed to the following fine resin particle emulsion.

Physical properties of the obtained toner were given in Table 1, and evaluation criteria using the evaluation apparatus A were given in Table 3.

—Synthesis of Fine Resin Particle Emulsion—

A reaction vessel equipped with a stirring bar and a thermometer was charged with water (683 parts), sodium salt of methacrylic acid-ethylene oxide adduct sulfate ester (ELEMINOL RS-30 product of Sanyo Chemical Industries, Ltd.) (11 parts), polylactic acid (10 parts), styrene (90 parts), methacrylic acid (60 parts), butyl acrylate (80 parts), and ammonium persulfate (1 part), and were stirred at 3,800 rpm for 30 minutes, to obtain a white emulsion. The emulsion was heated until the temperature in the system reached 75° C., and was allowed to react for 3 hours. A 1% ammonium persulfate aqueous solution (30 parts) was further added thereto, and the resultant mixture was aged at 75° C. for 4 hour, to thereby obtain an aqueous dispersion liquid of vinyl resin (copolymer of styrene/methacrylic acid/butyl acrylate/sodium salt of methacrylic acid-ethylene oxide adduct sulfate ester) [fine particle dispersion liquid 2].

The obtained [fine particle dispersion liquid 2] was measured by a particle diameter measuring apparatus (LA-920, product of HORIBA, Ltd.), and was found to have a volume average particle diameter of 40 nm. A part of the [fine particle dispersion liquid 2] was dried to thereby isolate a resin component. The resin component was found to have a glass transition point (Tg) of 62° C. and a weight average molecular weight of 49,000.

Comparative Example 1

[Toner 1'] was obtained in the same manner as in Example 1 except that the <Preparation of oil phase 1> was changed to the following.

Physical properties of the obtained toner were given in Table 1, and evaluation criteria using the evaluation apparatus A were given in Table 3.

<Preparation of Oil Phase 1'>

A vessel to which a stirring bar and a thermometer had been set was charged with 530 parts of the [non-crystalline low molecular polyester 1], 110 parts of the [release agent 4], 90 parts of the [crystalline polyester resin 1], and 947 parts of ethyl acetate, followed by heating to 80° C. during stirring. The mixture was maintained at 80° C. for 5 hours, and was cooled to 30° C. for 20 hours during slowly grown to be a crystal. Then, the vessel was charged with 100 parts of the [master batch 1] and 100 parts of ethyl acetate, and the mixture was mixed for 1 hour, to thereby obtain [materials dissolving solution 1'].

Comparative Example 2

[Toner 2'] was obtained in the same manner as in Example 1 except that the <Preparation of oil phase 1> was changed to the following.

Physical properties of the obtained toner were given in Table 1, and evaluation criteria using the evaluation apparatus A were given in Table 3.

<Preparation of Oil Phase 2'>

A vessel to which a stirring bar and a thermometer had been set was charged with 530 parts of the [non-crystalline low molecular polyester 1], 110 parts of the [release agent 5], 90 parts of the [crystalline polyester resin 1], and 947 parts of ethyl acetate, followed by heating to 80° C. during stirring. The mixture was maintained at 80° C. for 5 hours, and was cooled to 30° C. for 20 hours during slowly grown to be a crystal. Then, the vessel was charged with 100 parts of the [master batch 1] and 100 parts of ethyl acetate, and the mixture was mixed for 1 hour, to thereby obtain [materials dissolving solution 2'].

Comparative Example 3

[Toner 3'] was obtained in the same manner as in Example 1 except that the [non-crystalline low molecular polyester 1] was changed to the [non-crystalline low molecular polyester 4] described below, and that the <Preparation of oil phase 1> was changed to the following.

Physical properties of the obtained toner were given in Table 1, and evaluation criteria using the evaluation apparatus A were given in Table 3.

<Synthesis of Non-Crystalline Low Molecular Polyester 4>

A reaction vessel equipped with a condenser, a stirring device, and a nitrogen-introducing tube was charged with 450 parts of bisphenol A propylene oxide 2 mole adduct, 280 parts of bisphenol A propylene oxide 3 mole adduct, 247 parts of terephthalic acid, 75 parts of isophthalic acid, 10 parts of maleic anhydride, and 2 parts of titanium dihydroxy bis(triethanol aminate) as a condensation catalyst. Then, the resultant mixture was allowed to react at 270° C. for 20 hours while water generated in a nitrogen stream was removed. Next, the mixture was allowed to react under a reduced pressure of 5 mmHg to 20 mmHg. When the acid value thereof reached 8 mg KOH/g, the mixture was taken out, cooled to room temperature, and pulverized, to thereby obtain [non-crystalline low molecular polyester 4].

The obtained [non-crystalline low molecular polyester 4] was found to have a number average molecular weight of 5,800, a weight average molecular weight of 30,200, a glass transition point (Tg) of 61° C., and an acid value of 9 mg KOH/g.

<Preparation of Oil Phase 3'>

A vessel to which a stirring bar and a thermometer had been set was charged with 530 parts of the [non-crystalline low molecular polyester 4], 110 parts of the [release agent 5], 90 parts of the crystalline polyester resin 1], and 947 parts of ethyl acetate, followed by heating to 80° C. during stirring. The mixture was maintained at 80° C. for 5 hours, and was cooled to 30° C. for 20 hours during slowly grown to be a crystal. Then, the vessel was charged with 100 parts of the [master batch 1] and 100 parts of ethyl acetate, and the resultant mixture was mixed for 1 hour, to thereby obtain [materials dissolving solution 3'].

Comparative Example 4

[Toner 4'] was obtained in the same manner as in Example 1 except that the [non-crystalline low molecular polyester 1] was changed to the [non-crystalline low molecular polyester 5] described below, and that the <Preparation of oil phase 1> was changed to the following.

Physical properties of the obtained toner were given in Table 1, and evaluation criteria using the evaluation apparatus A were given in Table 3.

<Synthesis of Non-Crystalline Low Molecular Polyester 5>

A reaction vessel equipped with a condenser, a stirring device, and a nitrogen-introducing tube was charged with 450 parts of bisphenol A propylene oxide 2 mole adduct, 280 parts of bisphenol A propylene oxide 3 mole adduct, 247 parts of terephthalic acid, 75 parts of isophthalic acid, 10 parts of maleic anhydride, and 2 parts of titanium dihydroxy bis(triethanol aminate) as a condensation catalyst. Then, the resultant mixture was allowed to react at 200° C. for 5 hours while water generated in a nitrogen stream was removed. Next, the mixture was allowed to react under a reduced pressure of 5 mmHg to 20 mmHg. When the acid value thereof reached 8 mg KOH/g, the mixture was taken out, cooled to room temperature, and pulverized, to thereby obtain [non-crystalline low molecular polyester 5].

The obtained [non-crystalline low molecular polyester 5] was found to have a number average molecular weight of 3,800, a weight average molecular weight of 19,200, a glass transition point (Tg) of 60° C., and an acid value of 9 mg KOH/g.

<Preparation of Oil Phase 4'>

A vessel to which a stirring bar and a thermometer had been set was charged with 530 parts of the [non-crystalline low molecular polyester 5], 110 parts of the [release agent 4], 90 parts of the [crystalline polyester resin 1], and 947 parts of ethyl acetate, followed by heating to 80° C. during stirring. The mixture was maintained at 80° C. for 5 hours, and was cooled to 30° C. for 20 hours during slowly grown to be a crystal. Then, the vessel was charged with 100 parts of the [master batch 1] and 100 parts of ethyl acetate, followed by mixing for 1 hour, to thereby obtain [materials dissolving solution 4'].

Example 5

[Toner 5'] was obtained in the same manner as in Example 1 except that the [non-crystalline low molecular polyester 1] was changed to the [non-crystalline low molecular polyester 6] described below, and that the <Preparation of oil phase 1> was changed to the following.

Physical properties of the obtained toner were given in Table 1, and evaluation criteria using the evaluation apparatus A were given in Table 3.

<Synthesis of Non-Crystalline Low Molecular Polyester 6>

A reaction vessel equipped with a condenser, a stirring device, and a nitrogen-introducing tube was charged with 450 parts of bisphenol A propylene oxide 2 mole adduct, 280 parts of bisphenol A propylene oxide 3 mole adduct, 247 parts of terephthalic acid, 75 parts of isophthalic acid, 10 parts of maleic anhydride, and 2 parts of titanium dihydroxy bis(triethanol aminate) as a condensation catalyst. Then, the resultant mixture was allowed to react at 200° C. for 5 hours while water generated in a nitrogen stream was removed. Next, the mixture was allowed to react under a reduced pressure of 5 mmHg to 20 mmHg. When the acid value thereof reached 8 mg KOH/g, the mixture was taken out, cooled to room temperature, and pulverized, to thereby obtain [non-crystalline low molecular polyester 6].

The obtained [non-crystalline low molecular polyester 6] was found to have a number average molecular weight of 3,800, a weight average molecular weight of 19,200, a glass transition point (Tg) of 60° C., an acid value of 9 mg KOH/g.

<Preparation of Oil Phase 5'>

A vessel to which a stirring bar and a thermometer had been set was charged with 530 parts of the [non-crystalline low molecular polyester 6], 110 parts of the [release agent 5], 90 parts of the [crystalline polyester resin 1], and 947 parts of ethyl acetate, followed by heating to 80° C. during stirring. The mixture was maintained at 80° C. for 5 hours, and was cooled to 30° C. for 20 hours during slowly grown to be a crystal. Then, the vessel was charged with 100 parts of the [master batch 1] and 100 parts of ethyl acetate, followed by mixing for 1 hour, to thereby obtain [materials dissolving solution 5'].

TABLE 1-1

| | Amount of toner reduced when toner is heated at 165° C. for 10 min. (% by mass) | Amount of toner reduced when toner is heated to 250° C. after heated at 165° C. for 10 min. | Total amount of hydrocarbon compounds having 33 to 35 carbon atoms | Existence of core-shell structure | Amount of ethyl acetate (μg/g) |
|---|---|---|---|---|---|
| Example 1 | 0.1 | 1 | 53% | Yes | 4 |
| Example 2 | 0.4 | 0.2 | 55% | Yes | 7 |
| Example 3 | 0.4 | 5 | 40% | Yes | 13 |
| Example 4 | 0.01 | 0.1 | 68% | Yes | 1 |
| Example 5 | 0.1 | 5 | 50% | Yes | 3 |
| Example 7 | 0.1 | 1 | 52% | No | 3 |
| Comparative Example 1 | 0.5 | 0.03 | 38% | Yes | 32 |
| Comparative Example 2 | Less than 0.01 | 6 | 78% | Yes | 8 |
| Comparative Example 3 | Less than 0.01 | Less than 0.01 | 75% | Yes | 30 |
| Comparative Example 4 | 0.6 | 7 | 38% | Yes | 51 |
| Comparative Example 5 | Less than 0.01 | 6 | 76% | Yes | 28 |

TABLE 1-2

| | | Particle size distribution of toner | | |
|---|---|---|---|---|
| | Average circularity of toner | Weight average particle diameter ($D_4$) (μm) | number average particle diameter (Dn) (μm) | Ratio ($D_4$/Dn) |
| Example 1 | 0.97 | 4.6 | 4.2 | 1.10 |
| Example 2 | 0.96 | 4.4 | 3.9 | 1.14 |
| Example 3 | 0.98 | 3.7 | 3.4 | 1.09 |
| Example 4 | 0.95 | 4.1 | 3.7 | 1.11 |
| Example 5 | 0.94 | 5.4 | 4.6 | 1.17 |
| Example 7 | 0.98 | 6.8 | 5.5 | 1.24 |
| Comparative Example 1 | 0.97 | 4.8 | 4.1 | 1.17 |
| Comparative Example 2 | 0.96 | 5.1 | 4.5 | 1.13 |
| Comparative Example 3 | 0.93 | 6.7 | 5.7 | 1.18 |
| Comparative Example 4 | 0.93 | 4.2 | 3.1 | 1.35 |
| Comparative Example 5 | 0.94 | 5.4 | 4.6 | 1.17 |

TABLE 2

| | Release agent | Non-crystalline low molecular polyester during preparing oil phase | Evaluation apparatus |
|---|---|---|---|
| Example 1 | Release agent 1 | Non-crystalline low molecular polyester 1 | Evaluation apparatus A |
| Example 2 | Release agent 1 | Non-crystalline low molecular polyester 2 | Evaluation apparatus A |
| Example 3 | Release agent 2 | Non-crystalline low molecular polyester 1 | Evaluation apparatus A |
| Example 4 | Release agent 3 | Non-crystalline low molecular polyester 1 | Evaluation apparatus A |
| Example 5 | Release agent 1 | Non-crystalline low molecular polyester 3 | Evaluation apparatus A |
| Example 6 | Release agent 1 | Non-crystalline low molecular polyester 1 | Evaluation apparatus B |
| Example 7 | Release agent 1 | Non-crystalline low molecular polyester 1 | Evaluation apparatus A |
| Comparative Example 1 | Release agent 4 | Non-crystalline low molecular polyester 1 | Evaluation apparatus A |
| Comparative Example 2 | Release agent 5 | Non-crystalline low molecular polyester 1 | Evaluation apparatus A |

TABLE 2-continued

| | Release agent | Non-crystalline low molecular polyester during preparing oil phase | Evaluation apparatus |
|---|---|---|---|
| Comparative Example 3 | Release agent 5 | Non-crystalline low molecular polyester 4 | Evaluation apparatus A |
| Comparative Example 4 | Release agent 4 | Non-crystalline low molecular polyester 5 | Evaluation apparatus A |
| Comparative Example 5 | Release agent 5 | Non-crystalline low molecular polyester 6 | Evaluation apparatus A |

TABLE 3

| | Clogging of exhaust filter | Carrier spent property | Low temperature fixing ability |
|---|---|---|---|
| Example 1 | A | A | A |
| Example 2 | B | A | B |
| Example 3 | B | B | A |
| Example 4 | A | A | A |
| Example 5 | A | B | B |
| Example 6 | A | A | B |
| Example 7 | A | B | A |
| Comparative Example 1 | C | B | C |
| Comparative Example 2 | A | C | C |
| Comparative Example 3 | A | B | C |
| Comparative Example 4 | C | C | B |
| Comparative Example 5 | B | C | C |

Aspects of the present invention are as follows, for example:

<1> A toner including:

a binder resin;

a release agent; and a colorant, wherein a total amount of hydrocarbon compounds having 33 to 35 carbon atoms in the toner measured by ion attachment mass spectrometry (IAMS) is 40% to 70% in terms of a signal intensity ratio.

<2> The toner according to <1>, wherein an amount of the toner reduced when the toner is heated at 165° C. for 10 minutes is 0.01% by mass to 0.40% by mass, and an amount of the toner reduced when the toner is heated to 250° C. after heated at 165° C. for 10 minutes is 0.1% by mass to 5.0% by mass.

<3> The toner according to <1> or <2>, further including ethyl acetate as a volatile organic compound in an amount of 1 μg/g to 30 μg/g.

<4> The toner according to any one of <1> to <3>, wherein the toner has a core-shell structure.

<5> The toner according to any one of <1> to <4>, wherein the toner contains a polyester resin.

<6> The toner according to any one of <1> to <5>, wherein the toner contains a modified polyester resin.

<7> The toner according to any one of <1> to <6>, wherein an average circularity of the toner is 0.93 to 0.99.

<8> The toner according to any one of <1> to <7>, wherein a weight average particle diameter $D_4$ of the toner is 2 μm to 7 and a ratio ($D_4/D_n$) of the weight average particle diameter ($D_4$) to a number average particle diameter ($D_n$) of the toner is 1.00 to 1.25.

<9> A two-component developer including:

the toner according to any one of <1> to <8>; and a carrier having magnetism.

<10> A color-image forming apparatus including:

an electrostatic latent image bearer;

an electrostatic latent image forming unit configured to form an electrostatic latent image on the electrostatic latent image bearer;

a developing unit containing a toner and configured to develop the electrostatic latent image with the toner to form a visible image;

a transfer unit configured to transfer the visible image onto a recording medium to form a transferred image on the recording medium; and a fixing unit configured to fix the transferred image on the recording medium by a fixing member, wherein the color-image forming apparatus is a tandem developing system including at least four or more developing units having different developing colors disposed in series, a print speed of the color-image forming apparatus is 500 mm/sec to 2,500 mm/sec, and a contact pressure by the fixing member is 10 N/cm$^2$ to 150 N/cm$^2$, and wherein the toner is the toner according to any one of <1> to <8>.

<11> A process cartridge including:

an electrostatic latent image bearer; and a developing unit containing a toner and configured to develop an electrostatic latent image formed on the electrostatic latent image bearer with the toner to form a visible image, wherein the process cartridge is detachable to a main body of an image forming apparatus, and wherein the toner is the toner according to any one of <1> to <8>.

<12> A color-image forming method including;

forming an electrostatic latent image on an electrostatic latent image bearer; developing the electrostatic latent image with a toner to form a visible image; transferring the visible image onto a recording medium to form a transferred image on the recording medium; and fixing the transferred image on the recording medium by a fixing member, wherein the color-image forming method is performed by a tandem developing system including at least four or more developing units having different developing colors disposed in series, a print speed of the color-image forming apparatus is 500 mm/sec to 2,500 mm/sec, and a contact pressure by the fixing member of the color-image forming apparatus is 10 N/cm$^2$ to 150 N/cm$^2$, and wherein the toner is the toner according to any one of <1> to <8>.

This application claims priority to Japanese application No. 2014-236587, filed on Nov. 21, 2014 and incorporated herein by reference.

What is claimed is:

1. A toner comprising:

a binder resin;

a release agent, which is a paraffin wax comprising a hydrocarbon compound having 33 to 35 carbon atoms; and a colorant, wherein a total amount of hydrocarbon compounds having 33 to 35 carbon atoms in the toner measured by ion attachment mass spectrometry (IAMS) is 40% to 70% in terms of a signal intensity ratio, and a total amount of hydrocarbon compounds having 33 to 35 carbon atoms in the release agent is 40% to 70% in terms of a signal intensity ratio.

2. The toner according to claim 1, wherein an amount of the toner reduced when the toner is heated at 165° C. for 10 minutes is 0.01% by mass to 0.40% by mass, and an amount of the toner reduced when the toner is heated to 2500° C. after heated at 165° C. for 10 minutes is 0.1% by mass to 5.0% by mass.

3. The toner according to claim 1, further comprising ethyl acetate as a volatile organic compound in an amount of 1 μg/g to 30 μg/g.

4. The toner according to claim 1, wherein the toner has a core-shell structure.

5. The toner according to claim 1, wherein the toner contains a polyester resin.

6. The toner according to claim 1, wherein the toner contains a modified polyester resin.

7. The toner according to claim 1, wherein an average circularity of the toner is 0.93 to 0.99.

8. The toner according to claim 1, wherein a weight average particle diameter $D_4$ of the toner is 2 μm to 7 μm, and a ratio ($D_4/D_n$) of the weight average particle diameter ($D_4$) to a number average particle diameter ($D_n$) of the toner is 1.00 to 1.25.

9. A two-component developer comprising:

a toner; and a carrier having magnetism, wherein the toner comprises:

a binder resin, which is a paraffin wax comprising a hydrocarbon compound having 33 to 35 carbon atoms;

a release agent; and a colorant, wherein a total amount of hydrocarbon compounds having 33 to 35 carbon atoms in the toner measured by ion attachment mass spectrometry (IAMS) is 40% to 70% in terms of a signal intensity ratio, and a total amount of hydrocarbon compounds having 33 to 35 carbon atoms in the release agent is 40% to 70% in terms of a signal intensity ratio.

10. A color-image forming apparatus comprising:

an electrostatic latent image bearer;

an electrostatic latent image forming unit configured to form an electrostatic latent image on the electrostatic latent image bearer;

a developing unit containing a toner and configured to develop the electrostatic latent image with the toner to form a visible image;

a transfer unit configured to transfer the visible image onto a recording medium to form a transferred image on the recording medium; and a fixing unit configured to fix the transferred image on the recording medium by a fixing member, wherein the color-image forming apparatus is a tandem developing system including at least four or more developing units having different developing colors disposed in series and a contact pressure by the fixing member is 10 N/cm$^2$ to 150 N/cm$^2$, and wherein the toner is the toner according to claim 1.

11. A process cartridge comprising:

an electrostatic latent image bearer; and a developing unit containing a toner and configured to develop an electrostatic latent image formed on the electrostatic latent image bearer with the toner to form a visible image, wherein the process cartridge is detachable to a main body of an image forming apparatus, and wherein the toner is the toner according to claim 1.

12. A color-image forming method comprising:

forming an electrostatic latent image on an electrostatic latent image bearer;

developing the electrostatic latent image with a toner to form a visible image;

transferring the visible image onto a recording medium to form a transferred image on the recording medium; and fixing the transferred image on the recording medium by a fixing member, wherein the color-image forming method is performed by a tandem developing system including at least four or more developing units having different developing colors disposed in series and a contact pressure by the fixing member of the color-image forming apparatus is 10 N/cm$^2$ to 150 N/cm$^2$, and wherein the toner is the toner according to claim 1.

* * * * *